US005192945A

United States Patent [19]

Kusada

[11] Patent Number: 5,192,945

[45] Date of Patent: Mar. 9, 1993

[54] DEVICE AND METHOD FOR DRIVING A LIQUID CRYSTAL PANEL

[75] Inventor: Tokutarou Kusada, Tenri, Japan

[73] Assignee: Sharp Kabushiki Kaisha, Osaka, Japan

[21] Appl. No.: 803,910

[22] Filed: Dec. 9, 1991

Related U.S. Application Data

[63] Continuation of Ser. No. 430,422, Nov. 2, 1989, abandoned.

[30] Foreign Application Priority Data

Nov. 5, 1988 [JP] Japan ..... 63-280029
Dec. 23, 1988 [JP] Japan ..... 63-326472

[51] Int. Cl.[5] ..... G09G 1/28
[52] U.S. Cl. ..... 340/784
[58] Field of Search ..... 340/784, 701, 703, 799, 340/718; 358/236, 241; 359/85

[56] References Cited

U.S. PATENT DOCUMENTS 4,745,485 5/1988 Iwasaki ..... 358/236
4,791,415 12/1988 Takahashi ..... 340/701
4,908,710 3/1990 Wakai et al. ..... 340/784
4,980,775 12/1990 Brody ..... 340/781

*Primary Examiner*—Alvin E. Oberley
*Assistant Examiner*—Chanh Nguyen

[57] ABSTRACT

A circuit for driving a liquid crystal panel using a plurality of source drivers includes a separate line memory circuit for transmitting color signals to the even and odd line source drivers, respectively. Each line memory circuit includes digital color signal train forming circuits arranged according to a color order of the corresponding source lines upon receipt of analog color signals of the three colors in parallel, memories for successively storing the digital color signal train, circuits for alternately reading a first and second half memory area and circuits for latching and converting the read digital color signals in a prescribed order, to analog color signals of the three signals in parallel and transmitting the analog color signals to the corresponding source drivers.

21 Claims, 18 Drawing Sheets

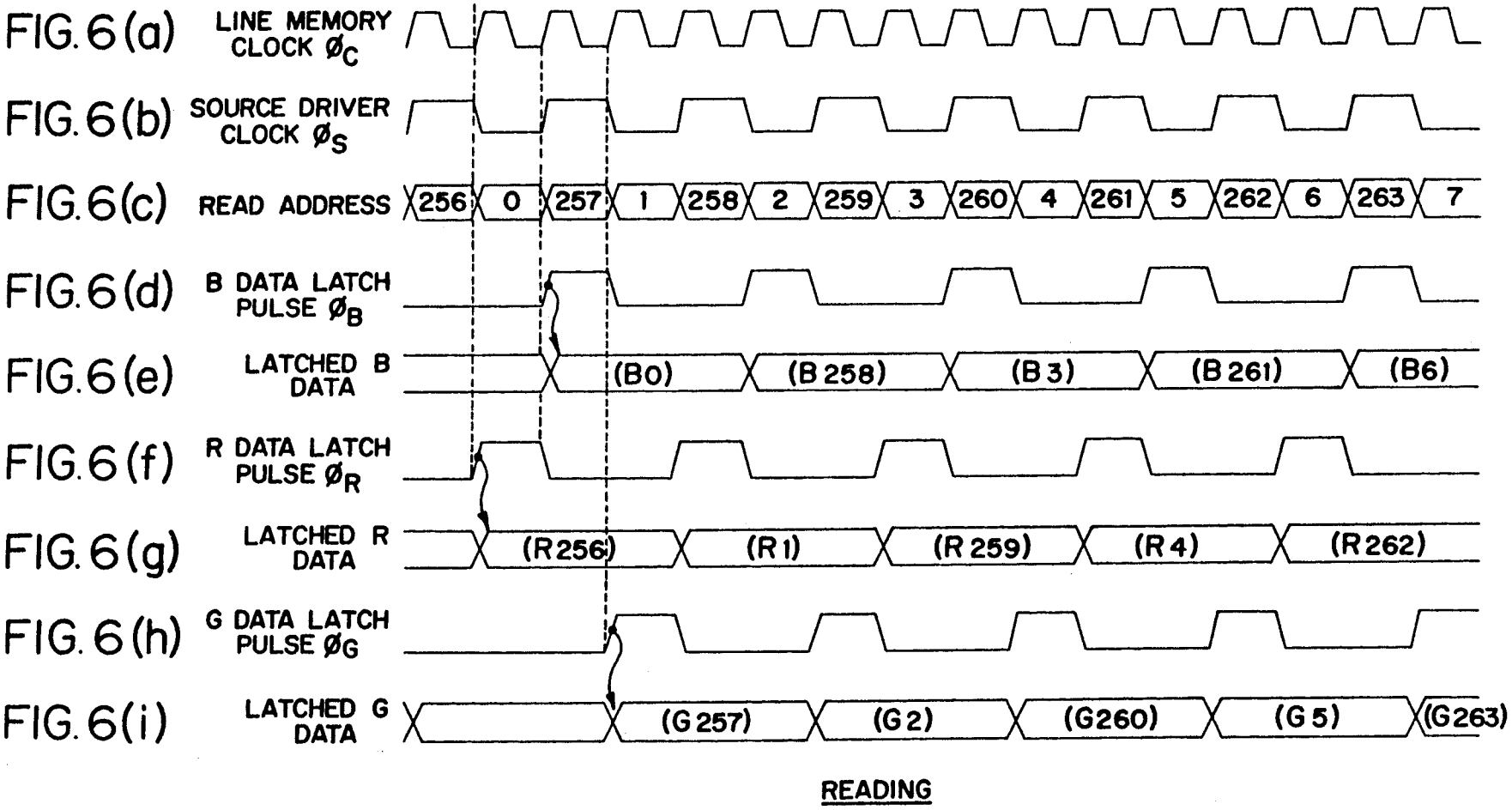
FIG. 6(a) LINE MEMORY CLOCK $\phi_C$
FIG. 6(b) SOURCE DRIVER CLOCK $\phi_S$
FIG. 6(c) READ ADDRESS
FIG. 6(d) B DATA LATCH PULSE $\phi_B$
FIG. 6(e) LATCHED B DATA
FIG. 6(f) R DATA LATCH PULSE $\phi_R$
FIG. 6(g) LATCHED R DATA
FIG. 6(h) G DATA LATCH PULSE $\phi_G$
FIG. 6(i) LATCHED G DATA
256
0
257
1
258
2
259
3
260
4
261
5
262
6
263
7
(B0)
(B258)
(B3)
(B261)
(B6)
(R256)
(R1)
(R259)
(R4)
(R262)
(G257)
(G2)
(G260)
(G5)
(G263)
READING

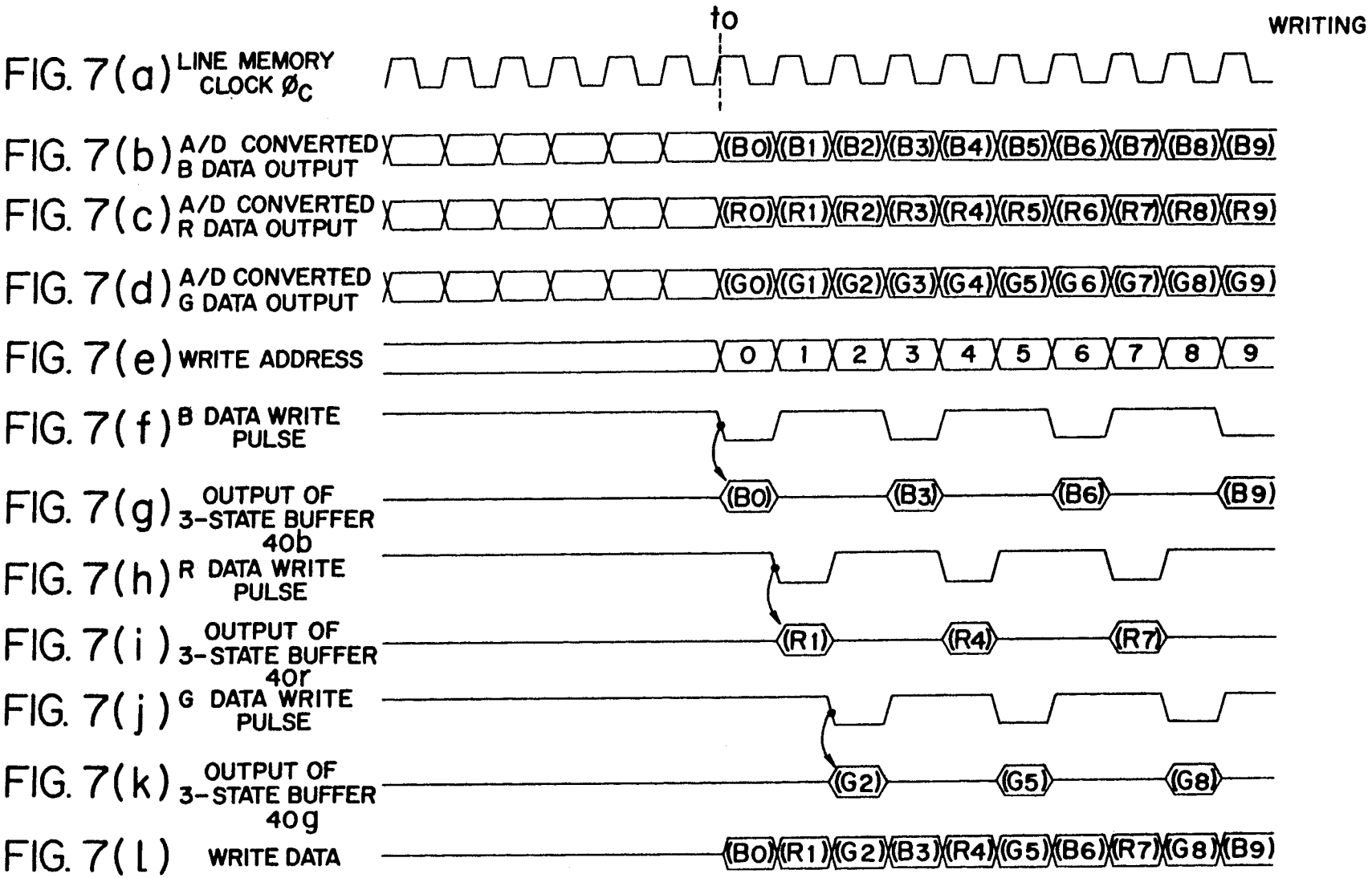
WRITING
to
FIG. 7(a) LINE MEMORY CLOCK ØC
FIG. 7(b) A/D CONVERTED B DATA OUTPUT
FIG. 7(c) A/D CONVERTED R DATA OUTPUT
FIG. 7(d) A/D CONVERTED G DATA OUTPUT
FIG. 7(e) WRITE ADDRESS
FIG. 7(f) B DATA WRITE PULSE
FIG. 7(g) OUTPUT OF 3-STATE BUFFER 40b
FIG. 7(h) R DATA WRITE PULSE
FIG. 7(i) OUTPUT OF 3-STATE BUFFER 40r
FIG. 7(j) G DATA WRITE PULSE
FIG. 7(k) OUTPUT OF 3-STATE BUFFER 40g
FIG. 7(L) WRITE DATA
(B0)(B1)(B2)(B3)(B4)(B5)(B6)(B7)(B8)(B9)
(R0)(R1)(R2)(R3)(R4)(R5)(R6)(R7)(R8)(R9)
(G0)(G1)(G2)(G3)(G4)(G5)(G6)(G7)(G8)(G9)
0 1 2 3 4 5 6 7 8 9
(B0) (B3) (B6) (B9)
(R1) (R4) (R7)
(G2) (G5) (G8)
(B0)(R1)(G2)(B3)(R4)(G5)(B6)(R7)(G8)(B9)

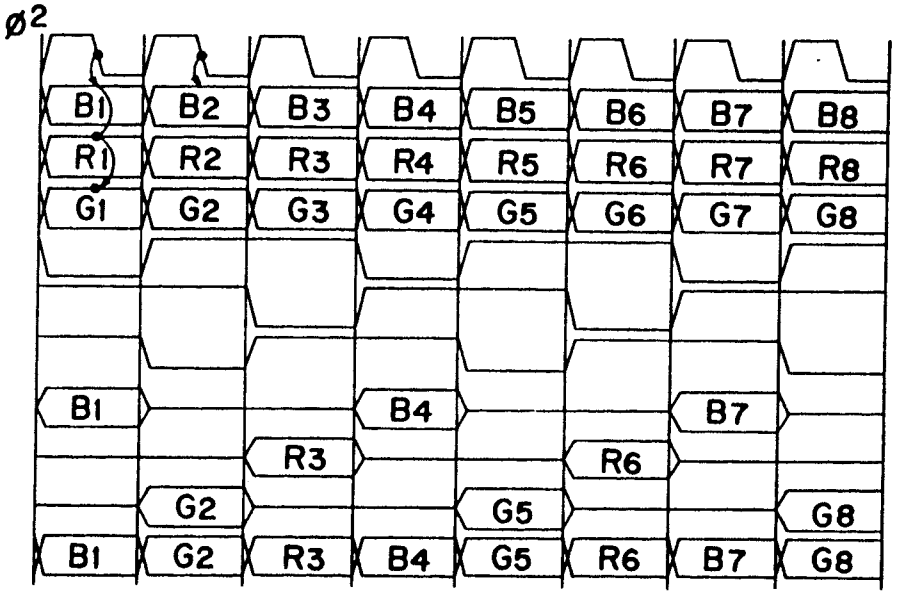
FIG. 16(a) LINE MEMORY CLOCK
FIG. 16(b) A/D DATA B
FIG. 16(c) A/D DATA R
FIG. 16(d) A/D DATA G
FIG. 16(e) $\overline{GB}$ GATE
FIG. 16(f) $\overline{GR}$ GATE
FIG. 16(g) $\overline{GG}$ GATE
FIG. 16(h) BUFFER DATA B
FIG. 16(i) BUFFER DATA R
FIG. 16(j) BUFFER DATA G
FIG. 16(k) COMPOSITE DATA TRAIN
ø2
B1 B2 B3 B4 B5 B6 B7 B8
R1 R2 R3 R4 R5 R6 R7 R8
G1 G2 G3 G4 G5 G6 G7 G8

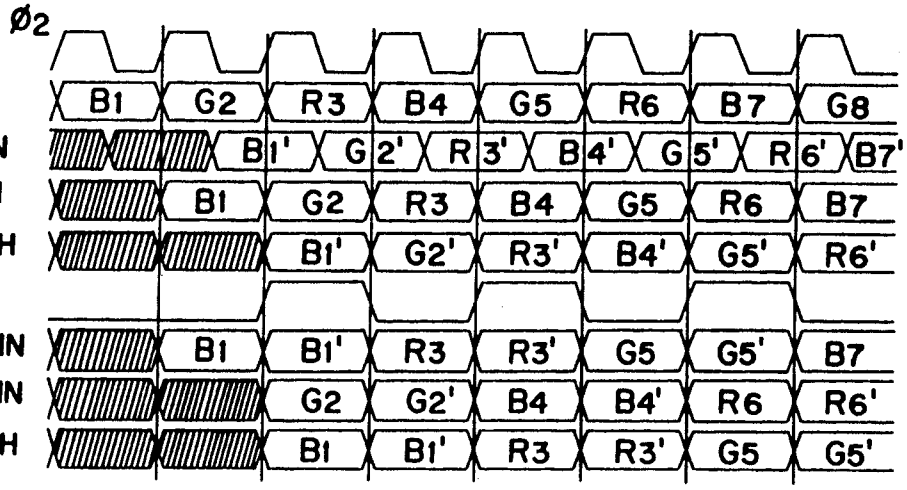
FIG. 18(a) LINE MEMORY CLOCK
FIG. 18(b) ODD GATE DATA TRAIN
FIG. 18(c) EVEN GATE DATA TRAIN
FIG. 18(d) ODD GATE DATA LATCH
FIG. 18(e) EVEN GATE DATA LATCH
FIG. 18(f) SEL
FIG. 18(g) ODD SOURCE DATA TRAIN
FIG. 18(h) EVEN SOURCE DATA TRAIN
FIG. 18(i) ODD SOURCE DATA LATCH
ø2
B1 G2 R3 B4 G5 R6 B7 G8
B1' G2' R3' B4' G5' R6' B7'
B1 G2 R3 B4 G5 R6 B7
B1' G2' R3' B4' G5' R6'
B1 B1' R3 R3' G5 G5' B7
G2 G2' B4 B4' R6 R6'
B1 B1' R3 R3' G5 G5'

(a) LINE MEMORY CLOCK $\phi_2$
(b) MEMORY WRITE ADDRESS
(c) ODD SOURCE DATA TRAIN
(d) EVEN SOURCE DATA TRAIN
0 512 1 513 670 159 671 256 768 257 414 926 415 927
B1 B1' R3 R3' G317' B319 B319' R321 R321' R323 B637 B637' R639 R639'
G2 G2' B4 B4' R318' G320 G320' B322 B322' R324 G638 G638' R640 B640'
1/2 HORIZONTAL PERIOD
1/2 HORIZONTAL PERIOD
$2^X = 2^8 = 256$, $2^Y = 2^9 = 512$ (a)
ADDRESS
0 159 512 671 1024
A1 B1
A B
ALTERNATE WRITING
FIRST 1/2 HORIZONTAL PERIOD
(b)
ADDRESS
0 159 256 415 512 671 768 927 1024
A1 A2 B1 B2
A B
ALTERNATE WRITING
SECOND 1/2 HORIZONTAL PERIOD

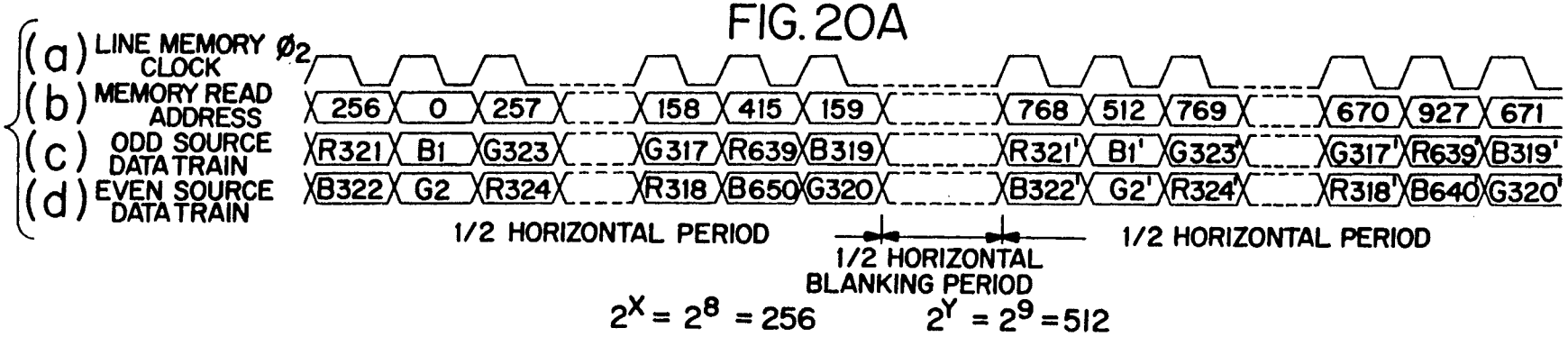
FIG. 20A
(a) LINE MEMORY CLOCK $\phi_2$
(b) MEMORY READ ADDRESS
(c) ODD SOURCE DATA TRAIN
(d) EVEN SOURCE DATA TRAIN
256 0 257 158 415 159 768 512 769 670 927 671
R321 B1 G323 G317 R639 B319 R321' B1' G323' G317' R639' B319'
B322 G2 R324 R318 B650 G320 B322' G2' R324' R318' B640' G320'
1/2 HORIZONTAL PERIOD
1/2 HORIZONTAL BLANKING PERIOD
$2^X = 2^8 = 256$
$2^Y = 2^9 = 512$
1/2 HORIZONTAL PERIOD

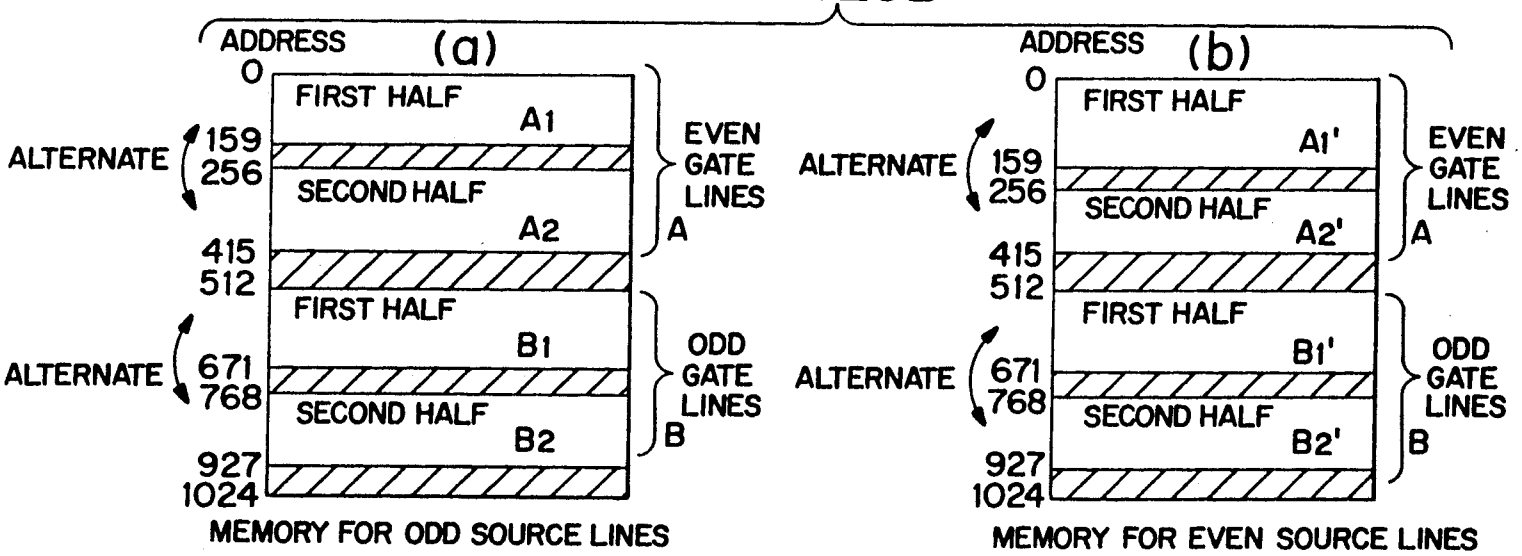
FIG. 20B
(a)
ADDRESS
0
FIRST HALF
A1
SECOND HALF
A2
FIRST HALF
B1
SECOND HALF
B2
EVEN GATE LINES A
ODD GATE LINES B
ALTERNATE
159 256
415 512
671 768
927 1024
MEMORY FOR ODD SOURCE LINES
(b)
ADDRESS
0
FIRST HALF
A1'
SECOND HALF
A2'
FIRST HALF
B1'
SECOND HALF
B2'
EVEN GATE LINES A
ODD GATE LINES B
ALTERNATE
159 256
415 512
671 768
927 1024
MEMORY FOR EVEN SOURCE LINES

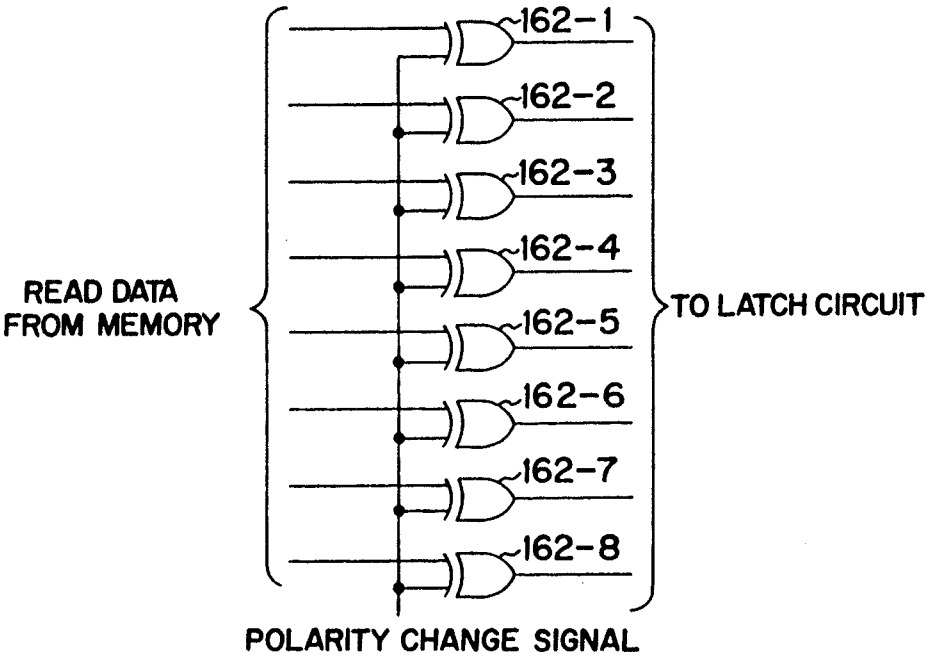
FIG. 21
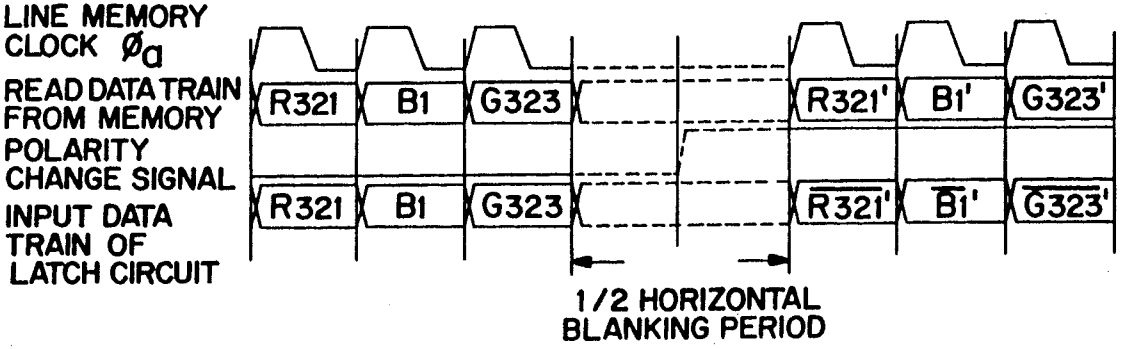
FIG. 22(a)
FIG. 22(b)
FIG. 22(c)
FIG. 22(d)

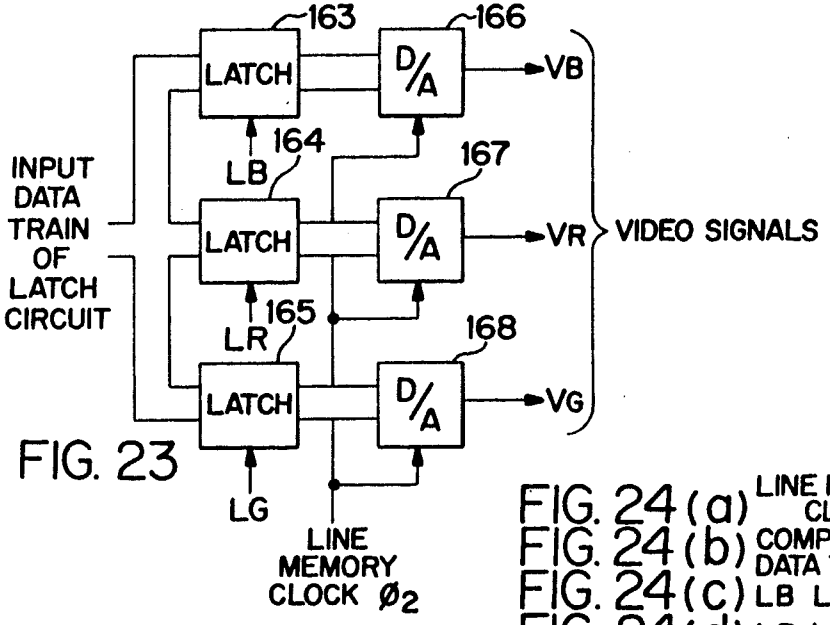
FIG. 23
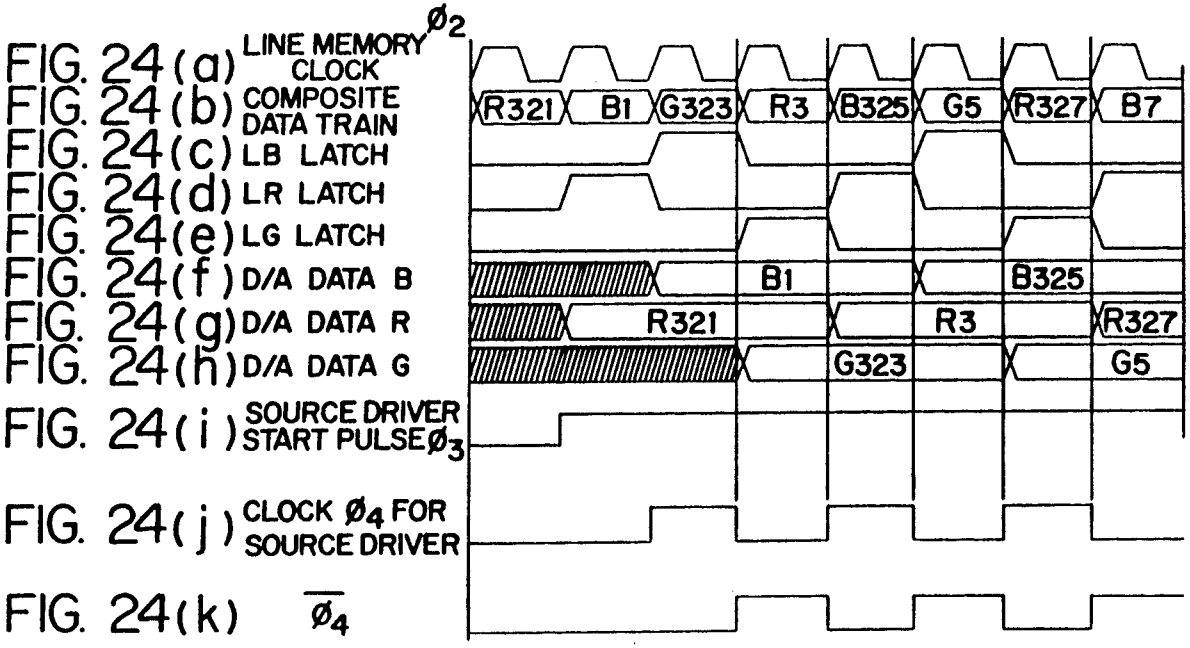
FIG. 24(a)
FIG. 24(b)
FIG. 24(c)
FIG. 24(d)
FIG. 24(e)
FIG. 24(f)
FIG. 24(g)
FIG. 24(h)
FIG. 24(i)
FIG. 24(j)
FIG. 24(k)

DEVICE AND METHOD FOR DRIVING A LIQUID CRYSTAL PANEL

This application is a continuation, of application Ser. No. 07/430,422 filed on Nov. 2, 1989, now abandoned.

BACKGROUND OF THE INVENTION

1. Field of the Invention

The present invention relates generally to devices and methods for driving liquid crystal panels, and particularly to a device and a method for driving an active matrix display type color liquid crystal display panel by using a low speed clock signal. More particularly, the present invention relates to a structure of a liquid crystal panel drive line memory circuit and a drive method thereof for applying a color signal to a series of signal electrodes included in the liquid crystal panel according to a high speed line sequential system.

2. Description of the Related Art

Display devices using a liquid crystal can be driven with low voltage and consequently they are utilized for applications which require low consumption of power. As an example of such applications, there are liquid crystal panels having a matrix arrangement of liquid crystal pixels and to be driven by successively applying a video signal to each liquid crystal pixel to display an image.

FIGS. 1A to 1C show schematically a structure of a conventional active matrix display type color liquid crystal panel.

Referring to FIG. 1A, pixels $P_{11}$, $P_{12}$, . . . , $P_{1(N-1)}$, $P_{1N}$, . . . , $P_{M(N-1)}$, $P_{MN}$ (pixels being generically denoted by the reference character P) are arranged in a matrix of M rows and N columns on a panel (i.e., an active matrix display type color liquid crystal panel) 1 to form a display screen (hereinafter referred to as a screen) 2. A thin film transistor, not shown, (hereinafter referred to as TFT) is provided in each pixel P in a one-to-one correspondence.

As shown in FIG. 1B, each pixel P comprises a TFT·Tr, a capacitor CA and a liquid crystal element LE. The TFT·Tr has its gate connected to a scanning line (i.e., a gate line) lx and its source connected to a source line ly. The capacitor CA accumulates signals transmitted from the source line ly through the TFT·Tr. The liquid crystal element LE transmits or interrupts light in response to a signal potential from the source line ly or the capacitor CA. A color filter, not shown, is disposed on the liquid crystal element LE and a desired color display is obtained through the color filter dependent on the transmission/interruption state of the liquid crystal element LE.

The gates of the TFTs of the respective rows are connected to the corresponding scanning lines (gate lines) 1×1, 1×2, 1×3, . . . 1×M. A scanning driver 4 activates the scanning lines 1×1 to 1×M successively. Thus, the screen 2 is scanned in the vertical direction.

The sources of the TFTs of the respective columns are connected to the corresponding source lines ly1, ly2, . . . , lyN. A color signal is transmitted from a source driver 3 (shown in FIG. 1C) to each of the source lines ly1 to lyN. A plurality of pixels P connected in common to one source line ly constitute a pixel row b1, r2, g3, b4, . . . , r (N−1), gN (a pixel row being generically denoted by a reference character Y) in which an order of colors is preset from the left to the right of the screen 2. The characters b, r, g represent pixels of colors corresponding to color video signals B (blue), R (red), G (green), and the numerals attached to those characters, 1, 2, 3 etc. represent the order of arrangement.

In the following description, a scanning line is generally indicated by the reference characters lx and a source line is generally indicated by the reference characters ly.

Referring to FIG. 1C, the source driving circuit (hereinafter referred to as the source driver) 3 comprises: a shift register 3*a* including output terminals $Q_1$ to $Q_N$ corresponding to the number N of source lines ly; an analog switch 3*b* including switching elements $S_1$ to $S_N$ provided corresponding to the output terminals $Q_1$ to $Q_N$ with a one-to-one relation; and an analog sample-and-hold circuit 3*c*.

The shift register 3*a* shifts the output in the direction from the output terminal $Q_1$ to the output terminal $Q_N$ to turn on the switching elements $S_1$ to $S_N$ successively one by one in the direction shown by the arrow y, whereby the color video signals B, R, G connected to the switching elements $S_1$ to $S_N$ are applied successively to the analog sample-and-hold circuit 3*c*.

The analog sample-and-hold circuit 3*c* holds the color video signals B, R, G accepted in one horizontal period of the screen 2 and outputs those signals individually to the corresponding pixel rows Y through the source lines ly in the subsequent horizontal period. Further at the same time, it accepts in parallel the color signals B, R, G for the subsequent horizontal period.

However, in the above described structure, if the number of pixels of the screen 2 is increased for the purposes of increasing the size of the panel 1 and enhancing the quality of image and the frequency of the clock pulses CK is increased as a result of requirement of high speed scanning, the linearity of the analog sample-and-hold circuit 3*c* is deteriorated and the consumption of power increases, making it difficult to meet such conditions.

Under the circumstances, it is proposed to use a method in which the screen 2 is divided into blocks and the divided blocks of pluralities of pixel columns are driven by corresponding source drivers, in order to attain high speed scanning by low speed source drivers and to reduce the size of the drive circuit.

FIG. 2 is a block diagram showing an electric construction of a conventional liquid crystal drive circuit. The liquid crystal drive circuit 21 comprises a plurality of source drivers 5 to 8 arranged in peripheral portions of the screen 2, and a plurality of line memory circuits 9 to 14 which supply color video signals R, G, B to the respective source drivers 5 to 8. Each of the line memory circuits 9 to 14 includes an A/D converter, a memory, a multiplexer, a latch circuit, a D/A converter and the like, as described later.

The screen 2 is constructed according to a multiplex matrix system. More specifically, the source lines ly are connected alternately to the upper and lower source drivers 5, 7; 6, 8, and each pixel row Y is divided into two portions, in the horizontal direction, i.e., the first half portion (driven by the source drivers 5, 6) and the second half portion (driven by the source drivers 7, 8). As a result, the screen 2 is formed by four portions, i.e., the respective portions corresponding to the pixel rows Y1 to Y4.

The plurality of source drivers 5 to 8 are arranged around the screen corresponding to the divided pixel rows Y1 to Y4. The color video signals R, G, B applied through the lines 11, 12, 13, respectively, are processed in six line memory circuits 9 to 14 by sequential operation such as analog-to-digital (A/D) conversion, writing, reading, latching and digital-to-analog (D/A) conversion. After that, the processed signals are supplied according to alternate signal strobe operation of the source drivers 5 to 8.

However, in the above described liquid crystal drive circuit, 21, two line memories are required for each of the color signals R, G, B, that is, six line memories in total are required. In addition, the circuit for each line memory is required to comprise, as shown in the block diagram in FIG. 3, an amplifying circuit 9*a* for the inputted color signal (e.g., B), an A/D converter 9*b* for digitally converting the inputted color signal, a buffer circuit 9*c*, a memory 9*d* for storing the digital data from the buffer circuit 9*c*, a write address generating circuit 9*e* and a read address generating circuit 9*f* for generating write/read addresses for the memory 9*d*, a multiplexer 9*h* for switching write/read operations of the memory 9*d* with prescribed timing and supplying the write address or the read address to the memory 9*d*, a latch circuit 9*i* for latching the data read from the memory 9*d*, a D/A converter 9*j* for converting the latched digital data to an analog signal, and a buffer 9*k* provided between the source driver and the D/A converter 9*j*. The switching of the write/read operations of the memory 9*d* is carried out under the control of a line memory control circuit 9*g* through the address multiplexer. In addition, the operation control (such as control of address generation timing) of the write address generating circuit 9*e* and the read address generating circuit 9*f* is carried out by the line memory control circuit 9*g*.

In addition to those line memory circuits 9 to 14 including the various components, it is necessary to further provide delay circuits and the like, not shown, for dissolving inconsistency between the input order of the color signals B, R, G to the line memory circuits 9 to 14 and the color order (the color filter arrangement) b, r, g etc. on a pixel row Y preset in the screen 2, and for changing the order of the data read from the memory 9*d* according to the order of arrangement of the pixel rows. More specifically, even in the multiplex matrix system, each of the source drivers 5 to 8 has the same structure as shown in FIG. 1C and successively receives and holds a color signal of one color in response to the clock signal CK. On the other hand, each of the line memories 9 to 14 transmits signals to the two source drivers. The signal from one line memory to the source driver (5 or 6) of the first half portion and that to the source driver (7 or 8) of the second half portion are alternately read and, on this occasion, the order of acceptance of the signals provided from the respective line memories 9 to 14 by the source drivers 5 to 8 need to be consistent with the color order of the pixel rows Y. Thus, a delay circuit or the like is required for the output portion of each of the line memories 9 to 14. Accordingly, each of the source drivers 5 to 8 drives only ¼ of the columns (160 columns in the figure) of the screen 2. In consequence, each of the line memories 9 to 14 can drive the liquid crystal panel at an operation speed equal to ½ of that in the case of one memory for each color and each of the source drivers 5 to 8 can drive the panel at an operation speed equal ¼ of that in the case of one memory for each color. However, the construction of the device is large-sized and complicated.

SUMMARY OF THE INVENTION

An object of the present invention is to provide a liquid crystal drive device having a simplified circuit construction and an excellent linearity.

Another object of the present invention is to provide a circuit for driving a liquid crystal panel of a multiplex matrix system, which does not require application of a high speed clock signal.

A further object of the present invention is to provide a circuit for driving a liquid crystal panel of a high speed line sequential system having color filters of a delta arrangement in response to a low speed clock signal with low consumption of power.

A further object of the present invention is to provide a method of driving a liquid crystal panel of a multiplex matrix system in response to a low speed clock signal with low consumption of power.

A further object of the present invention is to provide a method of driving a liquid crystal panel of a multiplex matrix system having color filters of a delta arrangement using a low speed clock signal.

A circuit for driving a color liquid crystal display panel according to the present invention includes: a plurality of drive means for driving source lines, and a plurality of first storing means for accepting color video signals R, G, B to be displayed and providing the color video signals R, G, B in an order required by the drive means.

Each of the first storing means includes: a plurality of analog-to-digital (A/D) converters for A/D conversion for each color of the video signals in one horizontal period; switching means for providing the digital-converted data according to an order of writing; at least a pair of second storing means for storing the digital-converted data and providing the same; data reading means for dividing the data in one horizontal period into two portions, i.e., the first half portion and the second half portion, and reading alternately the divided data of the first half portion and the second half portion from the second storing means; a plurality of latch circuits for latching the data read from the data reading means; and digital-to-analog (D/A) converters for D/A conversion of the data provided from the latch circuits.

A line memory circuit for driving a liquid crystal panel according to another aspect of the present invention includes: means for providing two types of video signals from a video signal of one horizontal period simultaneously for a first gate line (a scanning line) and for a second gate line forming a pair with the first gate line (the scanning line); and means for storing the two types of video signals thus provided by dividing those signals into at least eight groups corresponding to the first gate line, the second gate line, odd-numbered source lines and even-numbered source lines for the first and second gate lines, the source lines of the first half portion, and the source lines of the second half portion.

This line memory circuit further includes: means for reading, alternately pixel data to be transmitted from the storing means to the source lines of the first half portion for the first gate line and pixel data to be transmitted to the source lines of the second half portion and reading the pixel data for the second gate line in the same order as for the first gate line after the reading for the first line is terminated; means for transmitting the pixel data supplied from the reading means to the source drivers provided corresponding to at least two groups of the first half portion and the second half portion of the source lines; and signal lines arranged not to intersect with each other, for transmitting the outputs of the source drivers to the source lines of the liquid crystal panel.

In the circuit for driving the liquid crystal panel according to the present invention, color video signals R, G, B for one horizontal period in the first storing means are converted to digital data by the A/D converters. The converted digital data are outputted to the second storing means of the pair according to the writing order by the switching means and those data are stored together in the second storing means.

At the same time, the contents stored in the second storing means for the previous horizontal period is divided into the first half and the second half of one horizontal period and those divided portions are read alternately by the data reading means. The read data are converted to the color video signals R, G, B as analog signals by the D/A converters and inputted to the corresponding drive means. The plurality of drive means accept the data of the first half suitably and that of the second half outputted alternately, and drive the liquid crystal elements.

In a line memory circuit according to another aspect of the invention, two types of signals are provided simultaneously for the first line and the second line of the gate lines (the scanning lines) from the video signals for one horizontal period, and the data of the two types of video signals thus provided are written in the storing means. Then, the video signal data corresponding to one gate line is read from the storing means for a ½ horizontal period and applied to the source drivers as the pixel drive means. Thus, the liquid crystal panel can be driven according to the high speed line sequential system.

In addition, when the pixel data is read from the storing means, the video signal data corresponding to one gate line is divided into a first half and a second half of the source lines and the divided data are read alternately, whereby the video signals can be supplied alternately to the source drivers driving the first half and the second half of the source lines. Thus, it becomes possible to reduce the clock frequency defining the operation speed of the source drivers to ½ and to operate the source drivers in the high speed line sequential system with the same clock frequency as that in the conventional system. Consequently, the linear characteristic of the source drivers can be improved and the consumption of power can be reduced.

Although a position discrepancy corresponding to 1.5 pixel exists between the even-numbered gate lines and the odd-numbered gate lines in the color filters of the delta arrangement, it is possible to cope with this discrepancy by shifting the sampling clock phase by 1.5 clock at the time of converting an analog video signal to a digital signal.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIGS. 6(*a*)–(*i*) are timing charts explaining the read operation of the embodiment.

FIGS. 7(*a*)–(*l*) are timing charts explaining the write operation of the embodiment.

FIGS. 16(*a*)–(*k*) are timing charts showing operation of the A/D converters and the 3-state buffers shown in FIG. 15.

FIGS. 18(*a*)–(*i*) are timing charts showing operation of the data train converting circuit shown in FIG. 17.

FIGS. 20A(*a*)–(*d*) are timing charts showing operation of reading of data from the memories shown in FIG. 14.

FIG. 20B(*a*)–(*b*) is a schematic diagram showing the operation of the timing chart of FIG. 20A in the areas of the memories.

FIG. 21 shows an example of construction of the polarity changing circuit included in the line memory circuit shown in FIG. 14.

FIGS. 22(*a*)–(*d*) are timing charts showing operation of the polarity changing circuit shown in FIG. 21.

FIG. 23 is a block diagram showing an example of construction for converting one train of data contained in the line memory circuit shown in FIG. 14 to video signals corresponding to three colors R, G, B.

FIGS. 24(*a*)–(*k*) are timing charts showing operation of the latch circuits and the D/A converters shown in FIG. 23 and also showing operation for sampling the outputs of the D/A converters by means of the source drivers shown in FIG. 14.

DESCRIPTION OF THE PREFERRED EMBODIMENTS

Figure 4:
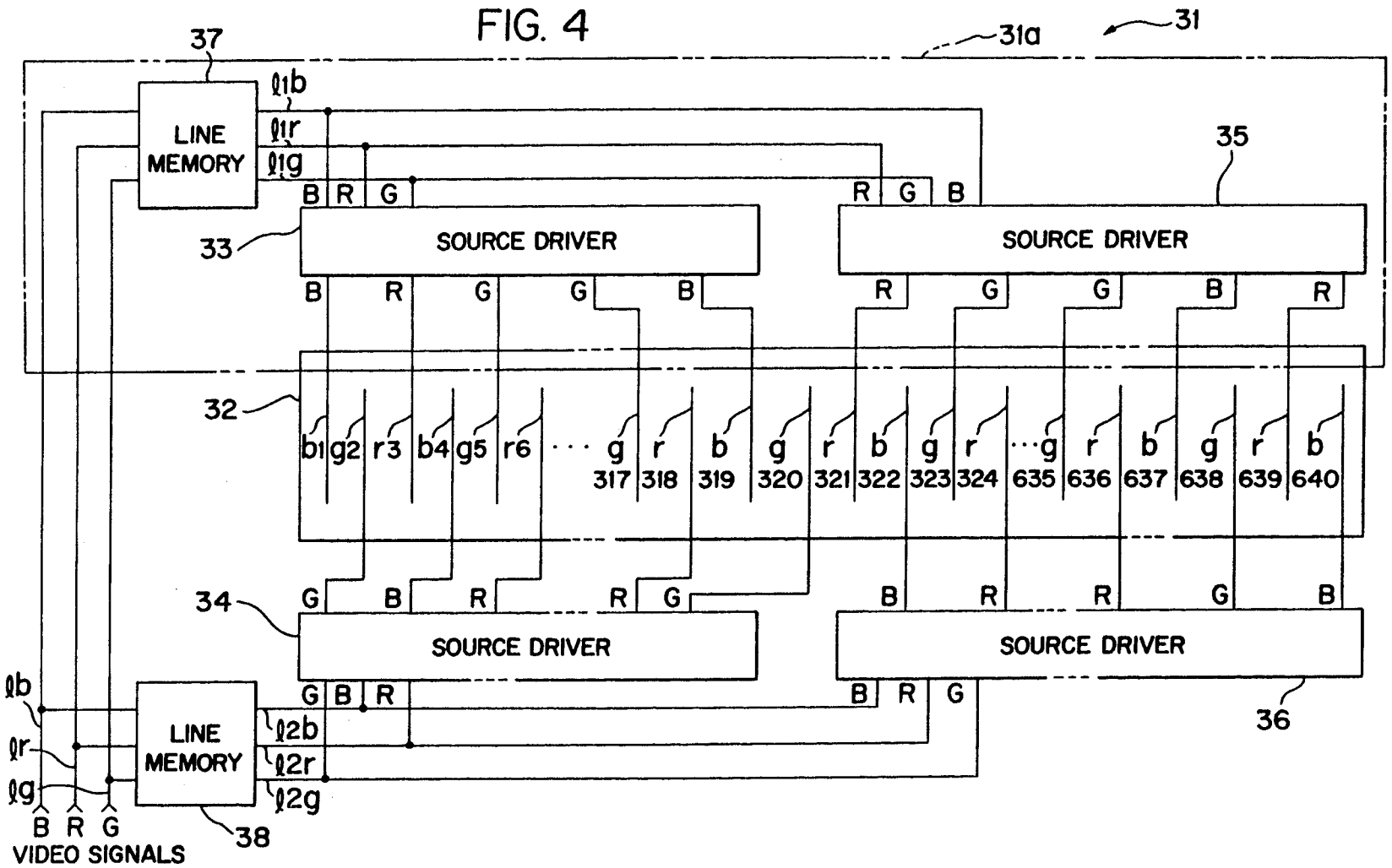
FIG. 4 is a block diagram showing an electric construction of a liquid crystal driving circuit of an embodiment of the present invention.

FIG. 4 shows schematically an electric construction of a liquid crystal driving circuit according to an embodiment of the present invention. Referring to FIG. 4, the liquid crystal driving circuit 31 comprises: source drivers 33, 34, 35, 36 for driving a display panel 32 divided into four areas for example; and a pair of line memory circuits 37, 38 for supplying color video signals R, G, B to the source drivers 33 to 36.

The source drivers 33 to 36 are arranged in left upper, right upper, left lower and right lower portions in the figure in the periphery of the display panel 32.

The line memory circuit 37 supplies the color video signals R, G, B to the source drivers 33, 35, while the line memory circuit 38 supplies the color video signals R, G, B to the source drivers 34, 36.

As is different from the prior art, the liquid crystal driving circuit 31 is constituted by using only two line memory circuits 37, 38.

Figure 2:
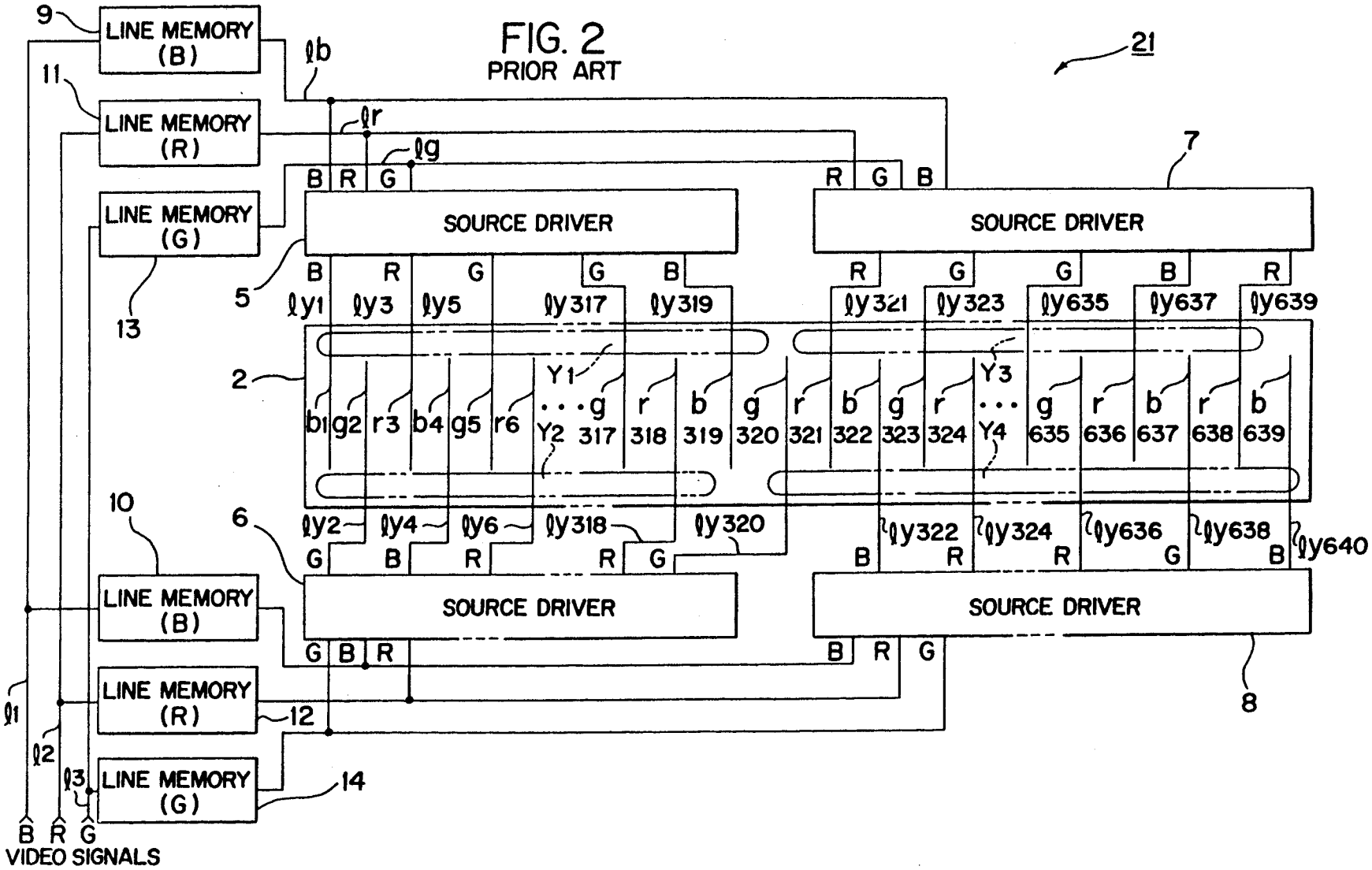
FIG. 2 PRIOR ART
FIG. 2 is a block diagram showing an electric construction of a conventional liquid crystal driving circuit.
Figure 3:
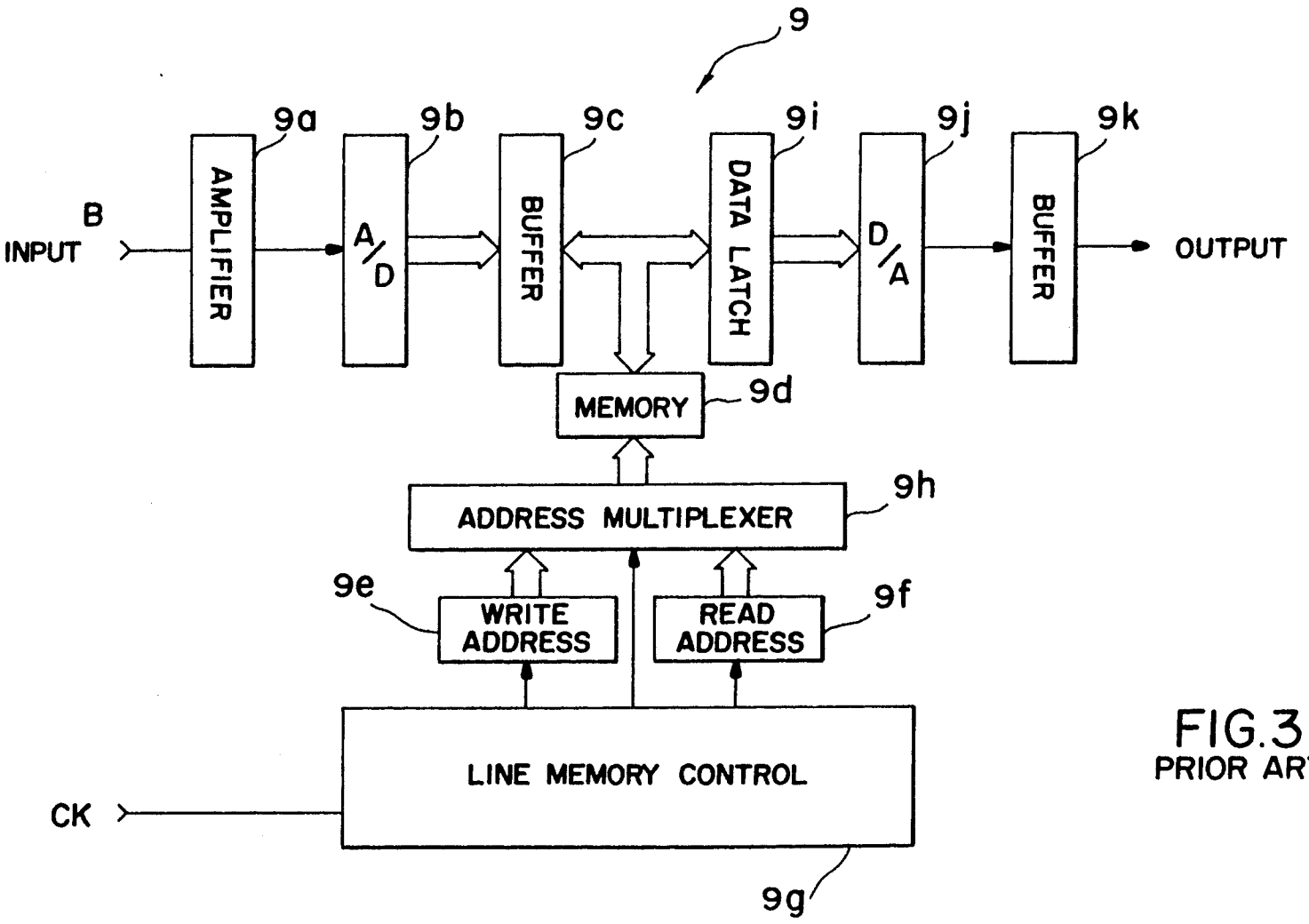
FIG. 3 PRIOR ART
FIG. 3 is a block diagram showing an electric construction of a line memory circuit for one color in the conventional circuit.

FIG. 4 shows as an example a case in which the number of pixel columns (source lines) in the horizontal direction of the screen (the horizontal direction in the figure) of the display panel (herein after referred to simply as the panel) 32 is 640. The 640 pixel columns are driven by the pair of line memory circuits 37, 38 and accordingly the number of pixel columns for one line memory circuit is 320. The panel 32 is constituted according to a multiplex matrix system as in the case of FIG. 2.

The left upper first source driver 33 and the right upper third source driver 35 are connected in common to lines 11*b*, 11*r*, 11*g* as output lines of the first line memory circuit 37. The left lower second source driver 34 and the right lower fourth source driver 36 are connected in common to lines 12*b*, 12*r*, 12*g* as output lines of the second line memory circuit 38.

Those four source drivers 33 to 36 are supplied with clock signals. For example, the left upper first source driver 33 is supplied with a clock signal of a phase of 0°; the left lower second source driver 34 is supplied with that of a phase of 90°; the right upper third source driver 35 is supplied with that of a phase of 180°; and the right lower fourth source driver 36 is supplied with that of a phase of 270°. Accordingly, the above mentioned source drivers 33 to 36 are activated in a circulating manner in the order of the left upper driver, the left lower driver, the right upper driver and the right lower driver, so that the video signals B, R, G are accepted from the corresponding line memory circuits 37, 38.

The panel 32 has an order of colors preset as B-G-R-B etc. from the left of the screen for example by color filters not shown. Accordingly, an arrangement of colors is set for each pixel row Y as b1, r2, g3, b4, . . . g638, r639, b640 from the left of the screen. Those 640 pixel columns b1 to b640 are divided into two halves at the center of the screen, and the pixel columns b1, r2, g3, . . . , b319, g320 included in the first half of one horizontal scanning period of the screen are driven alternately by the first and second source drivers 33 and 34 on the left of the screen, while the pixel columns r321, b322, c323, . . . r639, b640 included in the second half are driven alternately by the third and fourth source drivers 35 and 36 on the right of the screen.

The pair of line memory circuits 37, 38 which supply the color video signals R, G, B to the first to fourth source drivers 33 to 36 are only different in the order of color signals connected to the corresponding source drivers and in the clock phases for activation, and they operate in the same manner. The acceptance of each of the three colors of the color video signals R, B, G in the first to fourth source drivers 33 to 36 is carried out with a delay of one clock and it circulates for three clocks. Operation of this embodiment will be typically described with respect to the first line memory circuit 37 arranged in the upper portion of the screen and the drive circuit 31*a* shown by the chain lines in FIG. 4 formed by the first and third source drivers 33 and 35.

The order of supply of the respective color signals (R, B, G), that is, the order of reading of the signals from the first line memory circuit 37 with respect to the first and third source drivers 33 and 35 on the upper side of the screen included in the driver circuit 31*a* needs to be consistent with the order of the color arrangement of the pixel row Y defined by the color filters as described above. Accordingly, as shown, the color signals are supplied to the left first source driver 33 in the order of B-R-G-B etc. and the color signals are supplied to the right third source driver 35 in the order of R-G-B-R etc. On the other hand, the order of acceptance of the color video signals (R, G, B) by the first line memory 37 is the same as that for the first source driver 33, that is, the order of B-R-G etc. This order is used as the order of writing of the color signals in the first line memory circuit 37 as described later.

Figure 5:
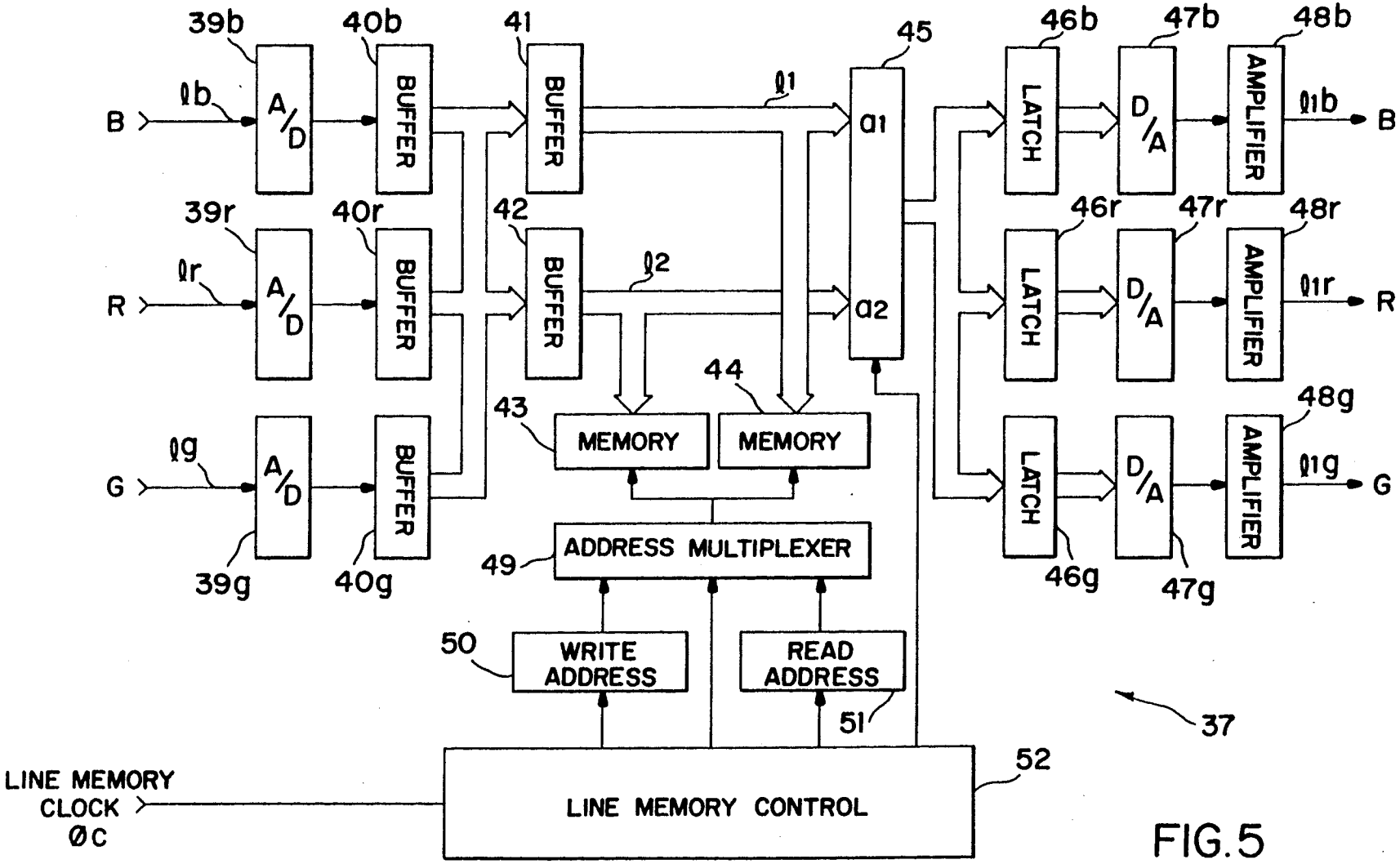
FIG. 5 is a block diagram showing an electric construction of a line memory circuit used in the embodiment.

FIG. 5 is a block diagram showing an electric construction of the line memory circuit 37 of this embodiment. The first and second line memory circuits 37 and 38 shown in FIG. 4 have the same construction. In the following, only the first line memory circuit 37 will be described typically. The characters b, r, g attached to the reference numerals correspond to the color signals B, R, G and in the case of general indications, only the reference numerals are used without the characters b, r, g.

The first line memory circuit 37 comprises: A/D converters 39*b*, 39*r*, 39*g* for A/D conversion of the respective color video signals B, R, G applied through line amplifiers not shown; and 3-state buffers 40*b*, 40*r*, 40*g* for on/off control of the digital data of the respective colors provided from the A/D converter 39 according to the order of writing in the memories described later.

The line memory circuit 37 further comprises: 3-state buffers 41, 42 for supplying write data provided from the above mentioned 3-state buffer 40 to a pair of memories 43, 44 at the time of writing; and a data multiplexer 45 for providing color signals Bd, Rd, Gd in the memory on the reading side out of the pair of memories 43, 44 capable of writing/reading, to a subsequent data latch circuit 46.

The line memory circuit 37 further comprises: data latch circuits 46*b*, 46*r*, 46*g* for latching data of the color signals provided from the data multiplexer 45 according to the reading order; a D/A converters 47*b*, 47*r*, 47*g* for converting the data latched by the data latch circuit 46 to analog signals; amplifiers 48*b*, 48*r*, 48*g* for amplifying the levels of the analog-converted color signals B, R, G and providing the outputs to the source drivers (as shown in FIG. 4); and an address multiplexer 49 for selectively instructing write/read operation and addresses for the memories 43, 44 with prescribed the timing.

The line memory circuit 37 further comprises: a write address generating circuit 50 for generating a write address in writing of data (in a write cycle), a read address generating circuit 51 for generating an address of the memory to be read in reading of data (in a read cycle), and a line memory control circuit 52 for controlling the operation of those circuit blocks.

Next, operation of the line memory circuit 37 will be described. The number of horizontal pixels related with the line memory circuit 37 is assumed to be N. Digital data corresponding to one row of pixels is written in one memory 43 or 44. In the meantime, the line memory circuit 37 supplies color video signals to both of the source driver 33 of the first half and the source driver 35 of the second half. Assuming that the memory area of one memory 43 or 44 corresponds to one row of pixels, it is necessary to divide the memory area into a first half and a second half. A boundary address between the first and second halves is obtained as follows.

$$2^x \geqq N/2$$

that is, $$X \geqq \log_2(N/2)$$

This value x is provisionally called a switching bit. The write address generating circuit 50 generates a write address A1 for writing the digital data of the first half period (H/2) of one horizontal period (H) in the order of 0, 1, . . . , j ($j<2^x$) according to the switching bit, and it generates a write address A2 for writing the digital data of the second half period (H/2) in the order of $2^x+0, 2^x+1, \ldots, 2^x+j$. Thus, the data to be transmitted to the source driver 33 of the first half is written in the area H of the address 0 to $j>2^x$ of the memory 43 or 44, while the data to be supplied to the source driver 35 of the second half is written in the memory area A2 of the address of $2^x$ or more. In consequence, assuming that the address is (x+1) bits, switching between the areas A1 and A2 can be easily effected if "0" is set in the address area A1 of the first half and "1" is set in the address area A2 of the second half.

Since each pixel row Y includes 640 pixel columns, N =320. In this case, x=8. Accordingly, the first half of the data of the 320 color signals B, R, G of the first horizontal period H1 is written in the address A1 (0 to j (j=159)) of one of the memories 43, 44 of the pair, for example, the memory 43, and the second half thereof is written in the address A2 ($2^8$ to $2^8+j$) of the same memory 43. This writing operation is carried out according to the write address generated by the write address generating circuit 50 under the control of the line memory control circuit 52.

In the next horizontal period H2, read/write operations of the memories 43, 44 are switched. Thus, the data are written in the addresses A1, A2 of the other memory 44, and at the same time, the data written in the memory 43 in the previous horizontal period H1 are read based on the read address designated by the read address generating circuit 51. The generation of the address and the switching of the operations are carried out by the line memory control circuit 52.

More specifically, the line memory control circuit 52 switches the read/write operations of the pair of memories 43, 44 for each horizontal period H and controls the address generating circuit 50, 51 and the multiplexer 49 to generate a write address and a read address while alternately changing the above mentioned first half-/second half switching bit X (X=8 in this embodiment) for the write address generating circuit 50 and the read address generating circuit 51.

Accordingly, as for the reading of the data, the data of the first and second halves are read alternately in one horizontal period $H_X$ from the memory (for example, the memory 43) having the data written in the previous horizontal period $H_{X-1}$ while the address changes as 0, $2^8$, 1, $2^8+1$, 2, etc., and in the next horizontal period $H_{X+1}$ writing/reading of the two memories 43 and 44 are switched, so that the data of the first and second halves are read alternately from the other memory 44 while the address changes as 0, $2^8$, 1, $2^8+1$, etc. The writing of the data is carried out in the same manner.

Thus, according to the present invention, the reading/writing operations of the memories 43, 44 are switched for each horizontal period H and while data are being read from one memory, data are written in the other memory. Further, one horizontal period H is divided into the first and second halves and writing/-reading operations are carried out alternately in those first and second halves. This construction simplifies the electric construction of the liquid crystal drive circuit 31 and realizes high speed operation.

In order to attain the above described operation, the first line memory circuit 37 comprises the 3-state write buffers 41, 42 on the write.input side of the pair of memories 43, 44, and the data multiplexer 45 on the read.output side, so that writing/reading of data are controlled by the line memory control circuit 52.

For example, assuming that the memory 43 is in a write cycle and the memory 44 is in a read cycle in one horizontal period H1, the second write buffer 42 connected to the second data line l2 is turned on and the digital data of the color video signals B, R, G obtained by A/D conversion are provided to the data line l2 and written in the memory 43. On the other hand, the second input terminal a2 of the data multiplexer 45 attains high impedance with respect to the data line l2, so that input of the above mentioned digital data is inhibited.

On the other hand, the first write buffer 41 connected to the first data line l1 attains high impedance and the first input terminal a1 of the data multiplexer 45 turns on. As a result, the digital data from the A/D converter 39 is not provided to the data line l1. Instead, the data read from the memory 44 is provided to the first data line l1 and applied to the data latch circuits **46*b*, 46*r*, 46*g* of the next stage through the data multiplexer 45**.

In the next horizontal period H2, the read/write cycles of the memories 43, 44 are reversed, so that reading is effected in the memory 43 and writing is effected in the memory 44. In this case, the output of the first write buffer 41 and the second input terminal a2 of the data multiplexer 45 are turned on, and the output of the second write buffer 42 and the first input terminal al of the data multiplexer 45 attains high impedance. The digital data from the A/D converter 39 is provided through the first data line l1 and written in the memory 44. On the other hand, data is read from the memory 43 and inputted to the data latch circuits **46*b*, 46*r*, 46*g* of the next stage from the second data line l2 through the data multiplexer 45**. Thus, writing/reading of the digital data of the color video signals B, R, G are carried out alternately.

The A/D converters 39b, 39r, 39g and the D/A converters 46b, 46r, 46g used in the line memory circuit 37 (similarly in the line memory circuit 38 in FIG. 4) convert data in response to the clock signal $\phi c$ applied to the line memory control circuit 52. The A/D converters 39b, 39r, 39g convert the analog color video signals B, R, G to digital data and output the same. The D/A converters 47b, 47r, 47g convert the digital data of the color video signals B, R, G provided from the latch circuits 46b, 46r, 46g to analog signals and supply the same to the lines 11b, 11r, 11g.

Since the respective color signals B, R, G are converted to digital data simultaneously by the A/D converting circuits 39b, 39r, 39g, the 3-state buffers 40b, 40r, 40g of the next stage are enabled successively one by one according to the writing order so that the digital data for one color is outputted successively and written in the memory 43 or 44. The digital data read from the memory 43 or 44 and passing through the data multiplexer 45 are inputted in parallel to the data latch circuits 46b, 46r, 46g and they are classified into three colors in response to the latch pulses applied with timing according to the reading order.

As for one color, since data is latched once for three clocks, the same data is converted into analog data for three clocks and triple oversampling occurs. As a result of the triple oversampling, the sampling clock frequency band can be caused to be outside the video signal frequency band, making it easy to design filters for removal of sampling clock interference provided in video signal amplifiers, not shown, connected in the preceding stage of each A/D converter 39 (39b, 39r, 39g) and in the succeeding stage of each D/A converter 47 (47b, 47r, 47g).

Since the order for supplying the color video signals B, R, G to the first and third source drivers 33 and 35 arranged on the left and right of the liquid crystal drive circuit 31a on the upper side of the screen 32 is the same as the order of colors set by the color filters (not shown) provided on the screen as described above, the left first source driver 33 has the order of B-R-G and the right second source driver 35 has the order of R-G-B.

On the other hand, the order of acceptance of the color video signals R, G, B by the line memory circuit 37 is the same as the acceptance order of B-R-G of the first source driver 33 as described later and this order is the order of writing in the memory 43 or 44. However, the order of the output of the accepted color video signals to the pixel row Y (namely, the source drivers 33, 35) is the order of b1-r321-r3-g323-g5-b325-b7 etc. if the output of the data to the first source driver 33 of the first half and that to the second source driver 35 of the second half are provided alternately, as shown in FIG. 4. In this case, it is necessary to output the color video signals of the same color of the second half and the first half successively from the line memory circuit 37. Accordingly there is not sufficient time for switching of the color video signals.

Therefore, as for the reading order, data are read alternately in the order of the second source driver 35 and the first source driver 33, which means the reversed order of the first and second halves in data reading. Thus, the order of reading of data is r312-b1-g323-r3-b325-g5 etc. and the respective source drivers 33, 35 can accept the video signals of the same color at equal intervals. This allows sufficient time for switching of the color video signals B, R, G in the line memory circuit 37. In consequence, the first line memory circuit 37 accepts the color video signals in the order of B-R-G in the first and second memories 43 and 44 and reads the data from the first and second memories 43, 44 in the order of R(second half)-B(first half)-G(second half)-R(first half)-B(second half)-G(first half) etc. so as to provide the color video signals B, R, G in the order required by the first and second source drivers 33 and 35.

FIGS. 6 and 7 are timing charts showing operation of the line memory circuit according to this embodiment. As described above, according to this embodiment, the screen 2 is divided into the upper and lower portions which are controlled by the first and second line memory circuits 37 and 38, respectively. Those two line memory circuits 37 and 38 operate in the same manner and those circuits are different only in the phases of the supplied operation clock signals and the orders of acceptance of the source drivers for the respective colors. Therefore, FIGS. 6 and 7 show the timing of the reading operation and that of the writing operation of only the first memory circuit 37.

FIG. 6(*a*) represents timing of a clock signal $\phi_C$ applied to the first line memory circuit 37, and FIG. 6(*b*) represents timing of a source driver clock signal applied to the first and third source drivers 33 and 35.

FIG. 6(*c*) represents a waveform of a read address signal provided from the read address generating circuit 51 shown in FIG. 5. As described above, according to this embodiment, the data of the color video signals R, G, B for one horizontal period is divided into first and second halves and the data of the second half is stored in the memory 43 or 44 from an address of 28. Namely, it is stored in the address 256, while the data of the first half is stored therein from the address 0. Accordingly, the read address generating circuit 51 provides, alternately the addresses where the data of the first and second halves are stored.

In the reading of the data, since the data of the same colors are read at equal intervals as in the order of R(second half)-B(first half)-G(second half)-R(first half)-B(second half)-G(first half), the data latch signals $\phi_R$, $\phi_G$, $\phi_B$ corresponding to the respective colors of the color video signals R, G, B are supplied for each pulse of the clock signals $\phi_C$ from the line memory control circuit 52 to the data latch circuits 46b , 46r, 46g separately. In response to the latch pulses, the data read in accordance with the read address signal shown in FIG. 6(*c*) is latched by the corresponding data latch circuit 46. On this occasion, since the first pixel column r321 of the second half of the screen 2 shown in FIG. 4 corresponds to the color video signal R(256) and the first pixel column b1 of the first half corresponds to the color video signal B(0), the data latch signals $\phi_B$, $\phi_R$, $\phi_G$ are provided in the order of B data latch $\phi_B$ - R data latch $\phi_R$ - G data latch $\phi_G$. FIGS. 6(*d*), (*f*), (*h*) represent the timings of the data latch signals thus provided corresponding to the respective colors.

FIG. 6(*e*) represents timing that the data of the color video signal B is sequentially latched in response to the B data latch signal $\phi_B$, and FIG. 6(*g*) represents timing that the data of the color video signal R is sequentially latched. Similarly, FIG. 6(*h*) represents timing that the data of the color video signal G is sequentially latched. The latch signals $\phi_B$, $\phi_R$, $\phi_G$ for latching the data of the respective colors have a rotation in three clocks of the clock signal $\phi_C$ shown in FIG. 6(*a*) and the data is latched once for three clocks in the latch circuit 46b, 46r, 46g.

The latched data are supplied to the D/A converters 47b, 47r and 47g of the succeeding stage, where they are converted to analog signals. Then, those analog signals are accepted successively by the first and second source drivers 33 and 35 with timing of the source driver clock $\phi_S$, and sampled and held therein. After that, the respective color signals from the source drivers 33, 35 to the source lines are transmitted with prescribed timing (e.g., with timing of the horizontal synchronizing signal), and the pixel p connected to the activated scanning line (gate line) lx illuminates.

FIG. 7(*a*) represents timing of the clock signal $\phi_C$ applied to the first line memory circuit 37, similarly to FIG. 6(*a*). In synchronization with the timing of the clock signal $\phi_C$, the respective A/D converters 39b, 39r, 39g convert the color video signals R, G, B to digital data in the same order as the arrangement order of pixels (the color order). FIGS. 7(*b*), (*c*), (*d*) represent timings of output of the digital-converted data of the respective colors. The time t0 defines timing of start of one horizontal period.

FIG. 7(*e*) represents timing of a write address signal outputted from the write address generating circuit 50. The address multiplexer 49 provides write signals ,$\psi_B$, $\psi_R$, $\psi_G$ of the respective colors in synchronization with the clock signal $\phi_C$ as shown in FIGS. 7(*f*), (*h*), (*j*). In response to the B data write signal $\psi_B$ in FIG. 7(*f*), the 3-state buffer 40b outputs the data of the color video signal B digital-converted by the A/D converter 39b as shown in FIG. 7(*g*). In response to the R data write signal $\psi_R$ in FIG. 7(*h*), the 3-state buffer 40r outputs the data of the color video signal R digital-converted by the A/D converter 39r as shown in FIG. 7(*i*). The same applies to the output of the data of the color video signal G shown in FIGS. 7(*j*) and (*k*). Since the respective data write signals $\psi_B$, $\psi_R$, $\psi_G$ are generated with a cycle of three clocks ($\phi_c$) to apply timing for sequentially writing the color video signals R, G, B, the data of the respective colors are written sequentially in the order of the color video signals B-R-G-B etc. starting with the first address of the memory 43 or 44, simultaneously with the start of one horizontal period.

In the above described construction, since the source drivers 33 to 36 are activated in the order of the source driver 33, the source driver 34, the source driver 35 and the source driver 36, the respective source drivers 33 to 36 are able to operate in response to the low speed clock signal $\phi_S$. In addition, only one pair of line memory circuits 37, 38 are provided and the data of the respective color signals are latched and outputted at a speed equal to ⅓ of that of the line memory clock $\phi_C$ in the respective line memory circuits 37, 38. This makes it possible to drive the liquid crystal panel at high speed by using the source drivers operating at low speed. Further, since only one pair of line memory circuits are provided and each line memory circuit can process the three colors, it is possible to obtain a small-sized and inexpensive liquid crystal drive circuit having a simple structure.

Figure 1A:
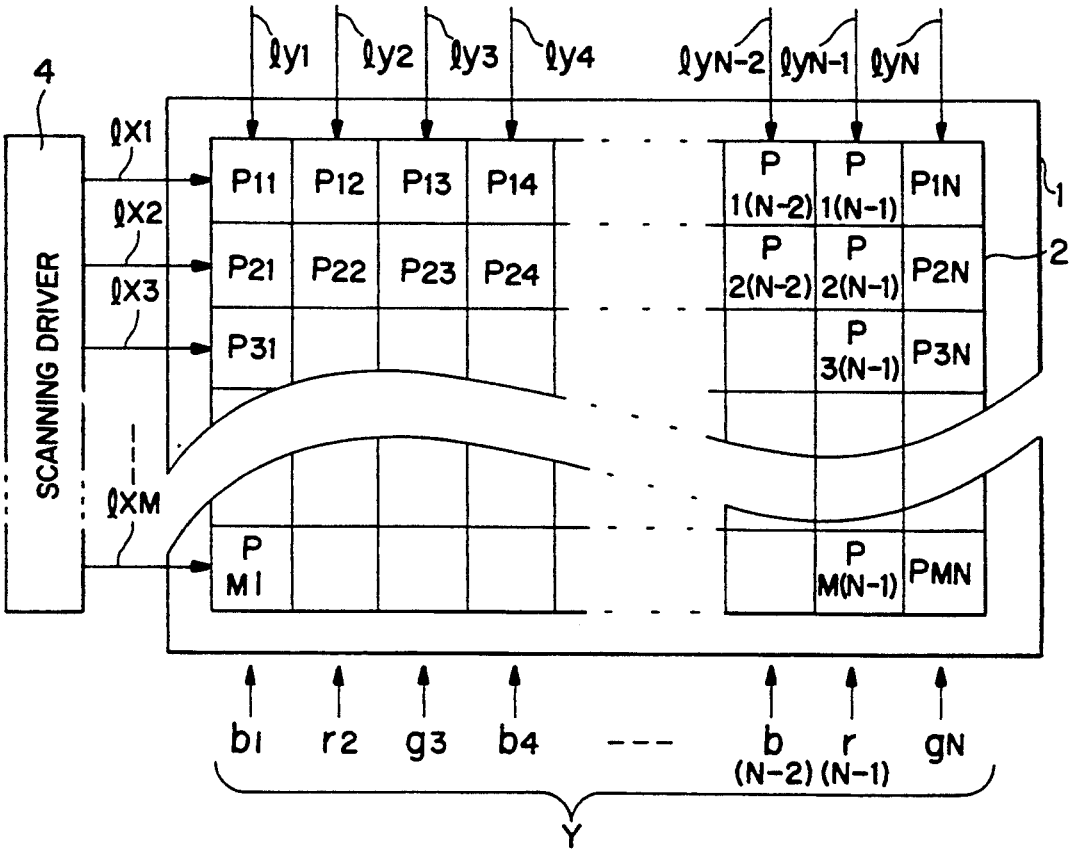
FIG. 1A PRIOR ART
FIG. 1 is a block diagram showing a structure of a conventional liquid crystal panel.
Figure 1B:
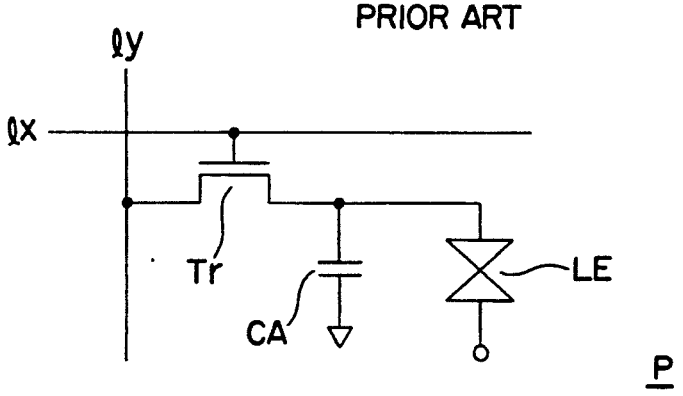
FIG. 1B PRIOR ART
Figure 1C:
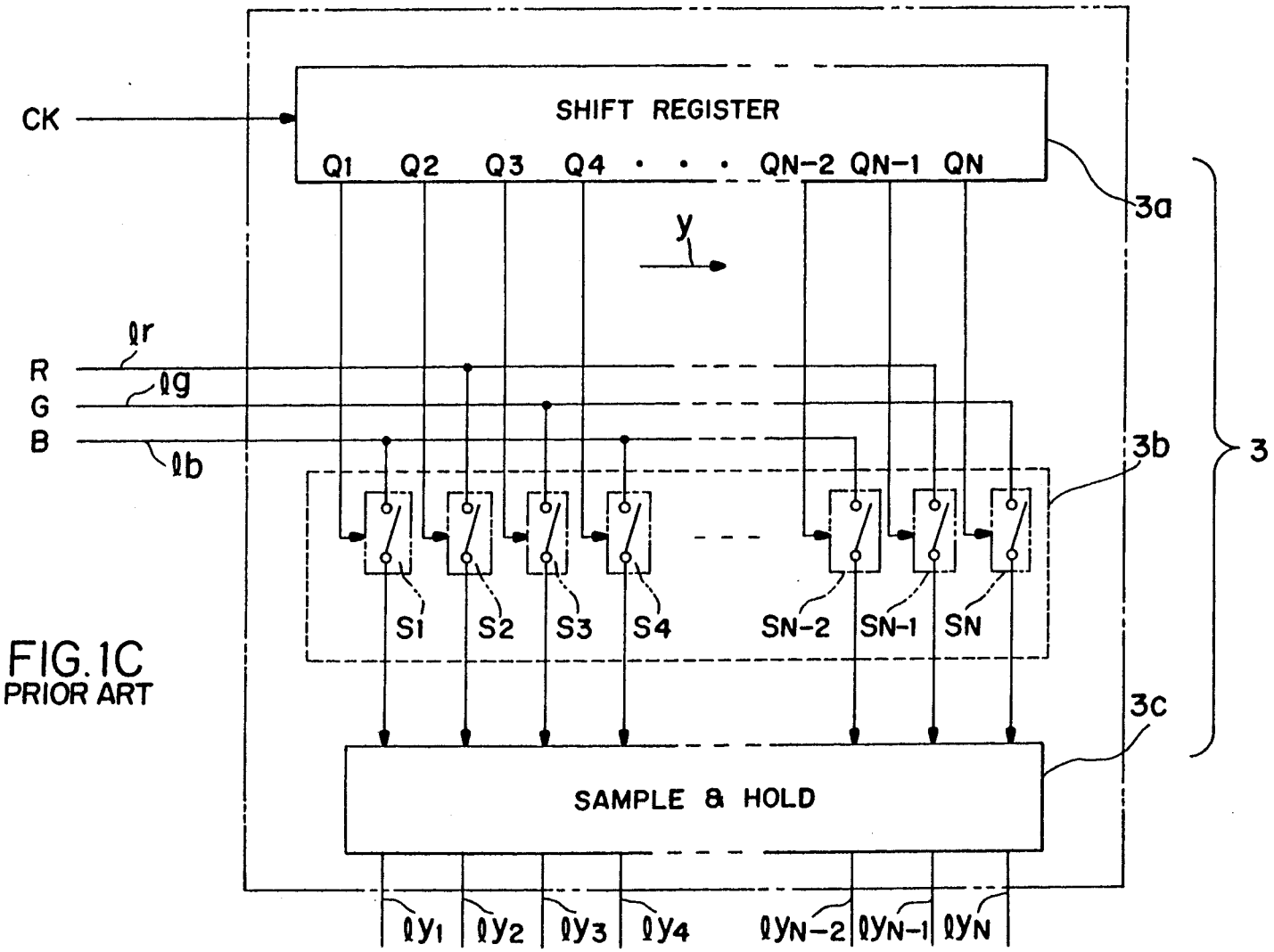
FIG. 1C PRIOR ART

In the above described structure, it is assumed that the same arrangement of colors is applied to the respective scanning lines (gate lines) and that the color filters (pixels) are arranged in a matrix of rows and columns. As for the scanning order of the scanning lines (gate lines), it was not specifically stated whether an interlace system or a non-interlace system is adopted. Since the scanning order is defined by the scanning driver 4 (as shown in FIG. 1A) in the above described structure, either system is applicable to the structure of the line memory circuits 37, 38.

However, if the color filters have a delta arrangement, it is necessary to take account of the timing of reading of data and the like according to the scanning system of the scanning lines. This point will be specifically described in the following.

In general, AC drive is required for operation of liquid crystals. Therefore, the polarity of the signal applied to the liquid crystal is inverted every prescribed cycles. More specifically, if a liquid crystal panel is to be driven, gate lines (i.e., signal lines for selecting a row to which a row of liquid crystal elements in the liquid crystal panel are connected; scanning lines) are scanned sequentially so that all the gate lines can be scanned in one field. In this case, the polarity of the video signal is inverted for one horizontal period according to the scanning of the gate lines. If the gate lines are so numerous that they cannot be scanned in the period of one field, two systems called the double line sequential system and the interlace system are conventionally utilized to scan all the gate lines in the prescribed one-field period.

Figure 8:
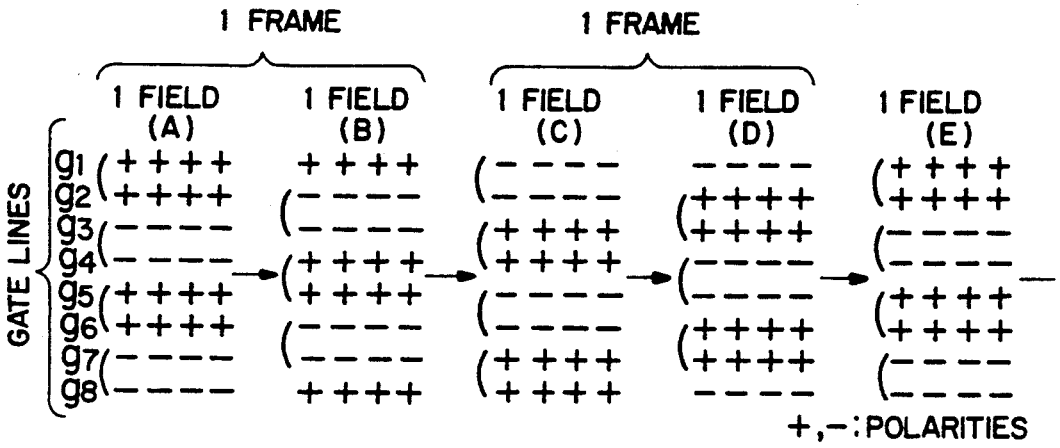
FIG. 8 PRIOR ART
FIG. 8 is an illustration showing a scanning order and inversions of polarities of gate lines in a double speed line sequential system.

According to the double speed line sequential system, pairs of two gate lines are scanned and those pairs of gate lines are alternately selected for each field, as shown in FIG. 8. In the field A, the gate lines g1, g2 forming a pair are scanned simultaneously and the gate lines g3, g4 forming a pair are also scanned simultaneously. Similarly, the pair of gate lines g5, g6 are scanned and the pair of gate lines g7, g8 are scanned. In this case, a positive signal is applied to each liquid crystal pixel in the gate lines g1, g2; a negative signal is applied to each liquid crystal pixel in the gate lines g3, g4; and a positive signal is applied to each liquid crystal pixel in the gate lines g5, g6. In the next field B, the gate lines g2, g3 forming a pair are scanned and the gate lines g4, g5 forming a pair are scanned. In the field B, a negative signal is applied to each liquid crystal pixel of the gate lines g2, g3 and a positive signal is applied to each liquid crystal pixel of the gate lines g4, g5. Similarly, in the fields C, D, E, the pairs of gate lines are selected and scanned sequentially. In this double speed line sequential system, the polarity of the signal for the liquid crystal pixels connected to one gate line is changed for two fields (i.e., one frame). One horizontal period (1H) is a period in which all the liquid crystal pixels connected to one gate line are driven, and this period corresponds to one horizontal scanning period of a display device of an ordinary raster scanning system. One field corresponds to a frequency of 60 Hz. This double speed line sequential system has an excellent responsitivity for moving pictures since all the gate lines can be scanned in the period of one field.

However, according to the above described double speed line sequential system, the respective pairs of two gate lines, namely, the odd-numbered gate lines and the even-numbered gate lines, are scanned simultaneously. Accordingly, if the color filters of a color display liquid crystal panel have a delta arrangement, correction for the delta arrangement cannot be effected. This results in deterioration of a horizontal resolution.

The delta arrangement mentioned above is a color arrangement of the color filters in which different colors, namely, color filters of R, G, B are arranged at respective apexes of an arbitrary regular triangle composed of pixels of the liquid crystal panel.

According to the interlace system, the gate lines are scanned alternately in each field and all the gate lines are scanned in two fields. More specifically, according to this interlace system, the odd-numbered gate lines g1, g3, g5, g7 are scanned in the field A and the even-numbered gate lines g2, g4, g6, g8 are scanned in the next field B. If the color filters of the liquid crystal panel have a delta arrangement and the signal electrodes for applying a signal potential to the pixels are arranged in a zigzag form, the odd-numbered gate lines and the even-numbered gate lines are staggered by 1.5 pixel. Consequently, the odd-numbered gate lines and the even-numbered gate lines cannot be driven with the same timing. However, according to this interlace system, only the odd-numbered gate lines or the even-numbered gate lines are scanned in each field. Accordingly, if the drive timing is applied with a difference of 1.5 pixel period for each field, correction for the delta arrangement of the color filters can be effected, making it possible to improve a horizontal resolution.

However, since only a half of all the gate lines are scanned for one field in the interlace system, the non-scanned gate lines maintain the image information supplied in the previous field until it is renewed by scanning in the next field. Thus, since each pixel maintains image information for one frame, responsitivity for moving pictures is deteriorated.

Figure 9:
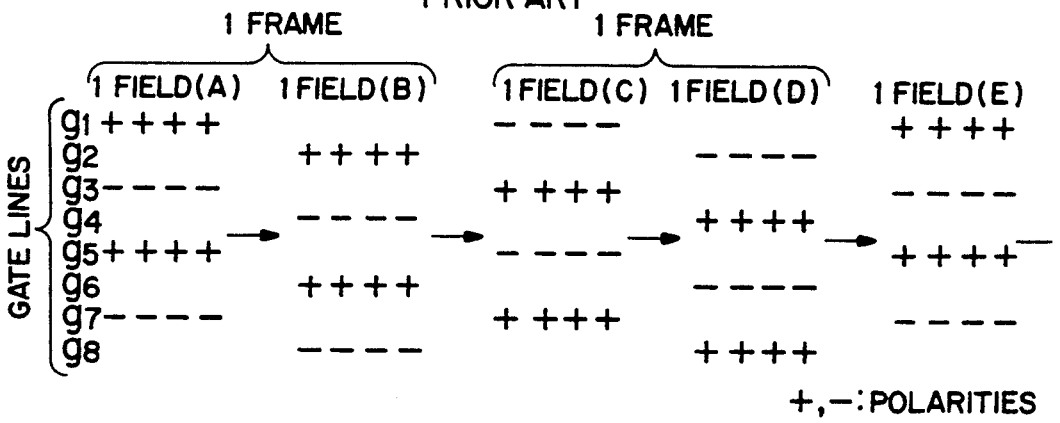
FIG. 9 PRIOR ART
FIG. 9 shows a scanning order and inversions of polarities of gate lines in an interlace system.

In addition, in both of the double speed line sequential system and the interlace system, the cycle of inversion of the polarities of the signals required for AC drive of the liquid crystal panel corresponds to two frames, namely, 15 Hz as shown in FIGS. 8 and 9 and accordingly flickering is liable to occur.

The above described disadvantages of the double speed line sequential system and the interlace system concerning the correction of the delta arrangement, the responsitivity for moving pictures and the occurrence of flickering can be overcome by the high speed line sequential system. In this high speed line sequential system, two gate lines are scanned in one horizontal period. However, the two gate lines are not scanned simultaneously. One of the gate lines is scanned in a half period of one horizontal period and the other gate line is scanned in the remaining half period, whereby the two gate lines are scanned in one horizontal period. Thus, this high speed line sequential system is different from the double speed line sequential system in this point.

Figure 10:
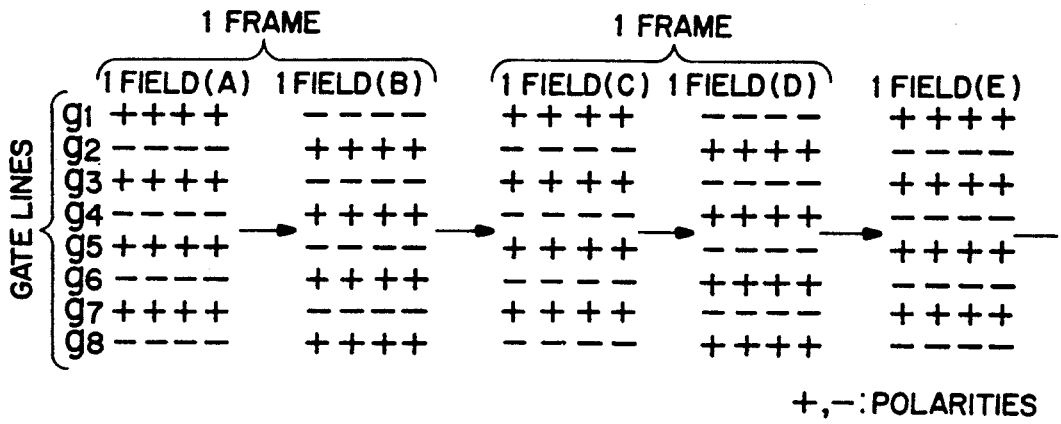
FIG. 10 shows a scanning order and inversions of polarities of gate lines in a high speed line sequential system.

More specifically, as shown in FIG. 10, according to the high speed line sequential system, the gate lines g1 and g2 forming a pair are selected and the gate line g1 is scanned in the first half period of one horizontal period and the gate line g2 is scanned in the remaining half period. Since the gate lines are scanned one by one in this high speed line sequential system, the delta arrangement can be corrected. Further, since two gate lines are scanned in one horizontal period, thus all the gate lines can be scanned in a one-field period, enhancing the responsitivity for moving pictures. In addition, since the gate lines are scanned individually one by one, it is possible to invert the polarity of the video signal when scanning in the ½ horizontal period, namely, scanning of one gate line is completed. Thus, the cycle of inversion of the polarities of the signal required for AC drive of the liquid crystal panel can be made to correspond to one frame, namely, 30 Hz to attain high-speed operation, making it possible to suppress flickering in the liquid crystal panel. Thus, as shown in FIG. 10, the polarity of the signal of the gate lines can be inverted for each of the frames A, B, C, D, E and the polarity inversion cycle of the signal corresponds to one frame.

However, according to this high speed line sequential system, it becomes necessary to drive the liquid crystal panel by supplying, to the source drivers, a video signal corresponding to the pixels connected to one gate line in a half horizontal period. More specifically, the applied video signal cannot be supplied as it is to the source drivers and it is necessary to effect processing such as time compression of a video signal for one horizontal period to a video signal for a half horizontal period.

In addition, in order to correct a delta arrangement of color filters, the timing of application of a video signal to the odd-numbered gate lines and that to the even-numbered gate lines need to differ by 1.5 pixel period. Accordingly, even if video signals for two gate lines are produced from a video signal for one gate line, those two types of video signals cannot be directly supplied to the source drivers and some signal processing is required. Furthermore, since one gate line is scanned in a half horizontal period and a signal potential for this gate line needs to be transmitted to each liquid crystal pixel, it is necessary to operate the source drivers which transmit the signal potential to each pixel, with a clock frequency twice larger than that in the conventional line sequential system or interline system, causing deterioration in the linear characteristic or increase of consumption of power.

Therefore, a line memory circuit for driving a liquid crystal panel according to another embodiment of the present invention has the below described construction.

First of all, before explanation of the specified construction of this embodiment, operation of the line memory circuit for driving the liquid crystal panel according to the present invention will be theoretically described. If the color filers of the liquid crystal panel have a delta arrangement and the signal electrodes of the liquid crystal pixels are arranged in a zigzag form in the liquid crystal panel, the arrangement of the pixels of the odd-numbered gate lines and that of the even-numbered gate lines are staggered by 1.5 pixel. Accordingly, if a video signal for one horizontal period is subjected to analog-digital (A/D) conversion so that digital video signals for two gate lines are provided, it is necessary to set a difference corresponding to 1.5 pixel between the clock timing for applying the A/D operation timing to the odd-numbered gate lines and that to the even-numbered lines. Practically, since the video signal is A/D converted for one clock for one pixel of the liquid crystal panel, a difference of 1.5 clock is given between the clocks applied to the A/D converter for the odd-numbered gate lines and that for the even-numbered gate lines.

The respective color signals R (red), G (green) and B (blue) of the video signals are divided for two gate lines, i.e., an odd-numbered line and an even-numbered line, and A/D conversion is effected for the respective two lines in parallel for one horizontal period with the above mentioned difference in timing corresponding to 1.5 clock.

The 3-state buffers are provided in the succeeding stage of the A/D converters provided corresponding to the respective colors R, G, B of the video signals. The operation timings of those 3-state buffers are controlled, whereby the data output timings of the respective colors R, G, B provided from the A/D converters are controlled to output the video data of the respective colors R, G, B in the same arrangement order as that of the color filters of the liquid crystal panel.

By the above described operation, video data for one horizontal period with respect to the odd-numbered gate lines and that with respect to the even-numbered gate lines are formed. The data train thus formed corresponding to one horizontal period is divided into the two groups of the odd-numbered gate lines and even-numbered gate lines. Accordingly, in the structure where the video data are written directly in the two memories, i.e., the one for the odd-numbered gate lines and the other for the even-numbered gate lines, data reading operation is effected only from one of the memories in a ½ horizontal period. This causes deterioration in the memory access efficiency and makes it necessary to read the video data from the memory for a half of the time required for writing of data (the time corresponding to one horizontal period). Therefore, in order to access the memories efficiently, not only in writing of data but also in reading of data, data train conversion is effected before the video signal data are written in the memories.

More specifically, the data trains divided into the two groups of the odd-numbered lines and the even-numbered lines are further distributed as video data corresponding to the odd-numbered source lines and video data corresponding to the even-numbered source lines. The video signals supplied to the source drivers become pixel data trains in which video data for pixels of the odd-numbered source lines and that of the even-numbered source lines appear alternately. Accordingly, if the above mentioned data train conversion is effected, reading of the video data for the even-numbered source lines and reading of the video data for the even-numbered source lines are effected alternately. In view of this, the two memories, the one for storing the video data for the odd-numbered source lines and the other for storing the video data for the even-numbered source lines are provided. In the case of the construction for the above described conversion of the data trains, data reading operations from those two memories are carried out alternately. Thus, the memory access efficiency is improved and it becomes possible to read the data simultaneously with writing of data.

The video signals, unless they are continuously processed would not enable drive of the liquid crystal panel for displaying an image. For this reason, another pair of memories i.e., the memory for storing the video data for the odd-numbered source lines and the other for storing the video data for the even-numbered source lines as described above are provided so that while writing operation is carried out in one of the pairs of memories, reading operation is carried out in the other pair of memories. Thus, switching is effected between the writing operation and the reading operation for one horizontal period in those two pairs of memories. By this switching structure, while video data is written in one of the pairs of memories, data is read out from the other pair of memories and thus the video signals can be processed continuously.

As to the address in writing of the data train in the memories, assuming that the number of pixels for one horizontal period (i.e., the number of liquid crystal pixels connected to one gate line) is N, in order to facilitate separation and switching between the first and second halves of the source lines in the same memory and between the odd-numbered and even-numbered gate lines, the switching bit X for switching the first and second halves of the source lines is $$X \geqq \log_2(N/4)$$

and the bit Y for switching between the odd-numbered and even-numbered gate lines is $$Y = X + 1.$$

As for the video data after the conversion of the data trains, the video data for the odd-numbered gate lines and that for the even-numbered gate lines are written alternately in the corresponding memories. More specifically, in the conversion of the data trains, the data of the odd-numbered gate lines and that of the even-numbered gate lines are written alternately with respect to the odd-numbered source lines for example. Similarly, the video data for the odd-numbered gate lines and that for the even-numbered lines are written alternately with respect to the even-numbered source lines. Accordingly, for each ½ horizontal period, the bit Y for switching between the odd-numbered and even-numbered gate lines is reset and set alternately in a repeating manner so that the write address is incremented by one. In consequence, the area of the memory where the video data for the odd-numbered gate lines is written for a ½ horizontal period corresponds to the reset of the switching bit Y and the video data for the even-numbered gate lines is stored in the address where the switching bit Y is set, namely, in the second half area of the memory.

The switching bit X for switching between the first and second halves of the respective source lines is reset and set for the first half of the horizontal period and for the second half of the horizontal period. Thus, the write position of the memory can be different dependent on the first half of the horizontal period and the second half thereof. As a result, the storage space of one pair of memories is divided into eight areas, namely, areas corresponding to the respective two gate lines, areas corresponding to the first and second halves of the odd-numbered source lines, and areas corresponding to the first and second halves of the even-numbered source lines. Further the corresponding video data is written in each of those eight areas.

In reading the video data from the memories, the order of arrangement of the read data needs to be coincident with the order of the video signals supplied to the source drivers. Accordingly, the switching bit X for switching of the first and second halves of the source lines are repeatedly reset and set alternately for each ½ horizontal period so that the read address is incremented by one. The switching bit Y for switching of the odd-numbered and even-numbered gate lines is reset or set according to the field dependent on the first ½ horizontal period and the second ½ horizontal period. More specifically, in a certain field, the switching bit Y is reset in the first ½ horizontal period and the switching bit Y is set in the second ½ horizontal period. In another field, the switching bit Y is set in the first ½ horizontal period and it is reset in the second ½ horizontal period.

The video data read from the memories according to the above mentioned read address is a digital signal. On the other hand, the video signal is applied to the source drivers in the form of an analog signal. Accordingly, the read video data needs to be converted from the digital signal to the analog signal and before this D/A conversion, digital polarity switching is carried out.

In a digital polarity switching circuit, inversion and non-inversion of the bit value of the data are effected in response to the polarity switching signal and the video signal having passed through the digital polarity switching circuit is converted from the digital data to analog data, whereby the polarity of the video signal is changed.

In the prior art, the construction for switching the video signal polarity is that an analog video signal is applied to an inversion amplifier and to a non-inversion amplifier so that the outputs of the respective amplifiers are switched and outputted by using an analog switch in response to the polarity switching signal. Accordingly, in the case of the conventional construction for switching the polarity in the analog form, three devices, namely, the inversion amplifier, the non-inversion amplifier and the analog switch are required. This increases the circuit size.

On the other hand, in the digital polarity switching circuit of the embodiment of the present invention, inversion and non-inversion of the bit value of the video data can be effected selectively in response to the switching signal by using an exclusive OR gate (Ex-OR) or the like and only one amplifier is required after the D/A conversion. Accordingly, it is not needed to provide two types of amplifiers such as an inversion amplifier and a non-inversion amplifier. Further, in the case of the construction of digital processing by A/D conversion of the video signal, such a polarity switching circuit can be realized with a small number of components.

The video data having passed through the digital polarity switching circuit needs to be subjected to D/A conversion to obtain video signals of the respective colors R, G, B. For this purpose, the latch circuits provided in the preceding stage of the D/A converters are operated according to the color order of the read data train, whereby the data of the respective colors are supplied to the corresponding D/A converters, where the data are converted to respective analog video signals. The analog video signals thus obtained are video signals for the high speed line sequential system. Further, a video signal corresponding to one gate line can be supplied to the source driver in a ½ horizontal period.

In the above described construction, the analog video signals of the three colors R, B, G are converted to video digital data by using the A/D converters provided corresponding to the respective colors and after the video signals of the three colors R, G, B are converted to one data train by adjusting the operation timings of the 3-state buffers provided in the succeeding stage of the respective A/D converters, desired digital processing is applied to the train. After that, by adjusting the operation timings of the latch circuits, the data train is separated as digital video data of the respective colors, which are supplied to the D/A converters provided corresponding to the respective colors R, G, B, so that those digital video data are converted to analog video signals.

By the above described construction, the digital processing circuit portions between the 3-state buffers and the latch circuits can process the data of the respective colors together without dividing the data, which makes it possible to reduce the number of components.

Figure 11:
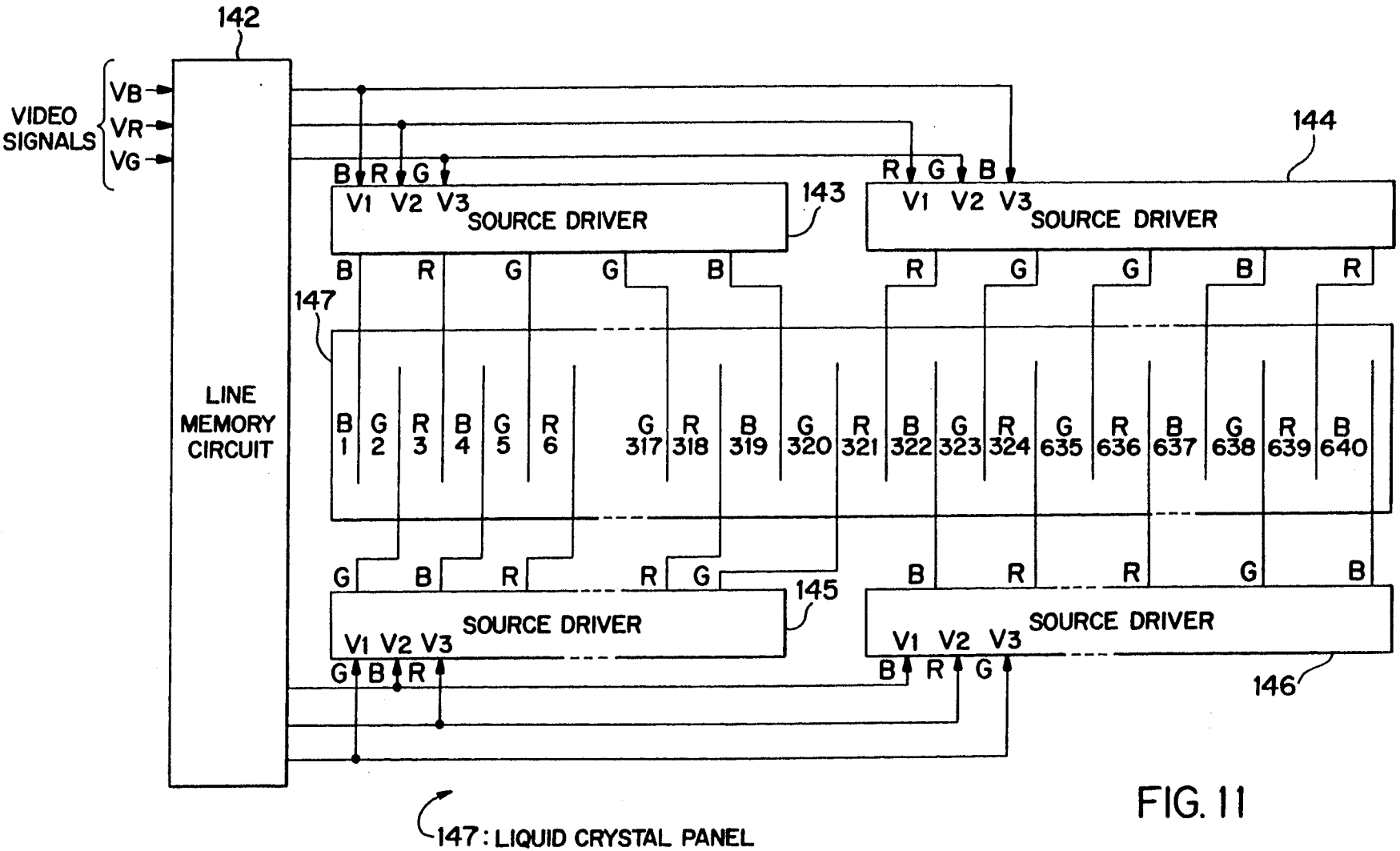
FIG. 11 shows a schematic structure of a liquid crystal panel.
Figure 12:
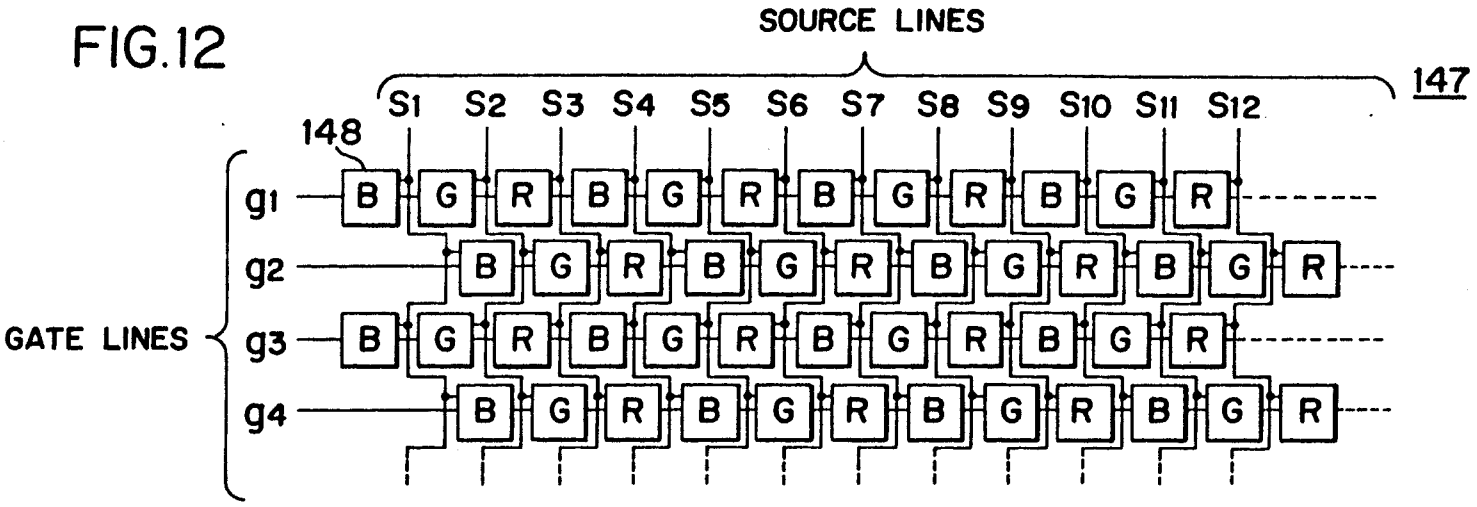
FIG. 12 shows an arrangement of color filters of the liquid crystal panel in FIG. 11.

Next, another embodiment of the invention will be described in detail with reference to the drawings. This embodiment is related to a case as shown in FIG. 11, in which the number of pixels of the liquid crystal panel 147 in the horizontal direction is 640 in total for all of the three colors R, G, B, the number of pixels in the vertical direction is 480, and the arrangement of color filters of this liquid crystal panel is a delta arrangement as shown in FIG. 12. Further, four source drivers 143, 144, 145 and 146 are provided to drive the liquid crystal panel 147, corresponding to four groups consisting of a group of odd-numbered source lines, a group of even-numbered source lines, and groups of the first half and second half portions of the respective source lines in the liquid crystal panel.

More specifically, referring to FIG. 11, the source driver 143 applies video signals to the odd-numbered source lines of the first half portion, and the source driver 144 applies video signals to the odd-numbered source lines of the second half portion. The source driver 145 applies video signals to the even-numbered source lines of the first half portion, and the source driver 146 applies video signals to the even-numbered source lines of the second half portion. In this case, the number of source lines is 640 as described above and the respective source lines are denoted sequentially by the numerals of 1 to 640 in the same manner as in FIG. 4. In addition, in the construction in FIG. 11, the characters B, G, R of the liquid crystal panel 147 represent the colors of the pixels and the numerals shown under the respective characters B, G, R represent the numerals assigned to the source lines. The scanning drivers for driving the gate lines are not shown in the figure.

As described above, the number of source lines of the liquid crystal panel 147 is 640 which is equal to the number of pixels in the horizontal direction, and the number of gate lines is 480 which is equal to the number of pixels in the vertical direction. The source lines are arranged in a zigzag form in the liquid crystal panel 147 as shown in FIG. 12 since the color filters are arranged in a delta form, and one source line drives liquid crystal pixels of the same color in the respective gate lines.

In addition, as clearly shown in FIG. 11, the signal output terminals of the source drivers 143 to 146 are connected with the source lines of the liquid crystal panel 147 so that the connections do not intersect with each other.

As definitely shown in FIG. 12, the arrangement of the pixels 148 of the liquid crystal panel 147 has a staggering by 1.5 pixel between the odd-numbered gate lines and the even-numbered gate lines.

Figure 13:
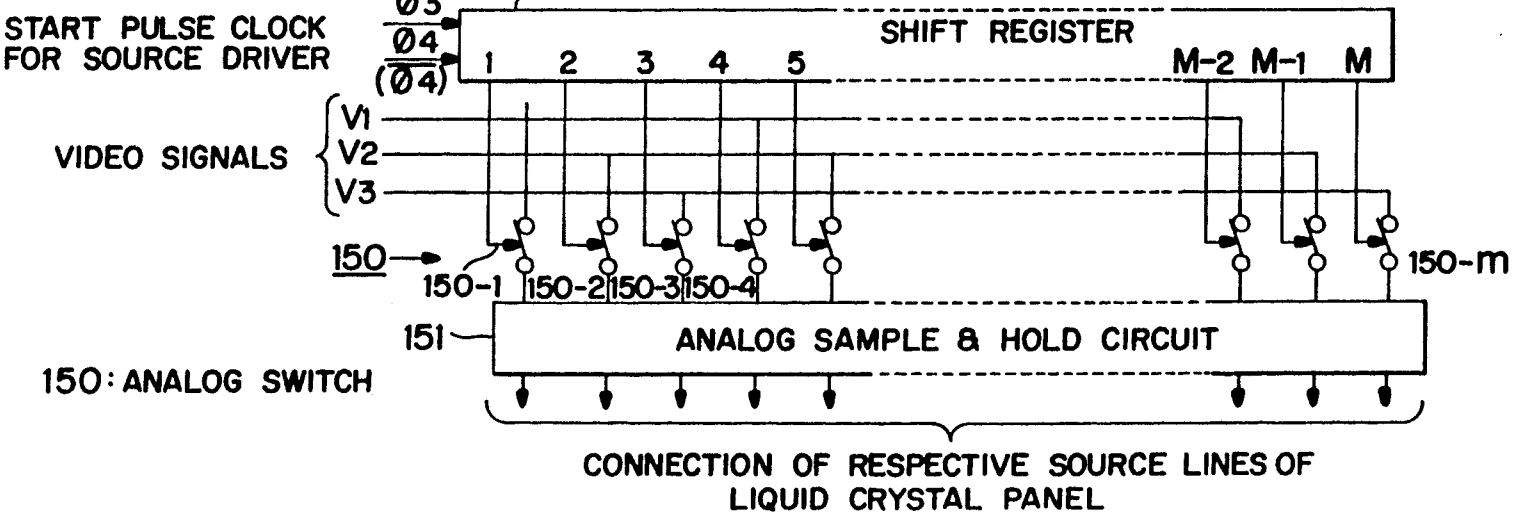
FIG. 13 is a diagram showing an example of structure of source drivers for driving the liquid crystal panel shown in FIG. 12.

Each of the source drivers 143 to 146 for driving the respective source lines of the liquid crystal panel 147 has a structure as shown in FIG. 13.

Referring to FIG. 13, the source driver comprises: a shift register 149 activated in response to a start pulse $\phi 3$ for shifting a selection activation signal from the output terminal one by one in response to a clock $\phi 4$; analog switches 150-1 to 150-m for transmitting respective video signals V1 to V3 in response to the selection activation signals from the shift register 149; and an analog sample-and-hold circuit 151 for sampling and holding the video signals applied through the analog switches 150 (150-1 to 150-m) and supplying the held video signals to the corresponding source lines when the signals for all the source lines are held.

The analog switches 150 are turned on successively in response to the selection activation signals from the shift register 149 to transmit the corresponding video signals to the analog sample-and-hold circuit 151. The video signals V1 to V3 correspond to the video signals of the respective colors R, G, B and those video signals of the respective colors are transmitted in parallel. Accordingly, in this structure, if the R video signal is transmitted to the analog sample-and-hold circuit 151, the video signals of the remaining colors are not transmitted. Thus, only the video signal of one color, namely, the video signal of one pixel is always transmitted to the analog sample-and-hold circuit 151 through the analog switch 150.

Further, the shift register 149 has a structure of 160 stages (m=160) in order to drive ¼ of the 640 pixels of one row, namely, one gate line of the liquid crystal panel. The analog sample-and-hold circuit 151 samples and holds the signals transmitted through the analog switches 150 while supplying the signals to the source lines.

Figure 14:
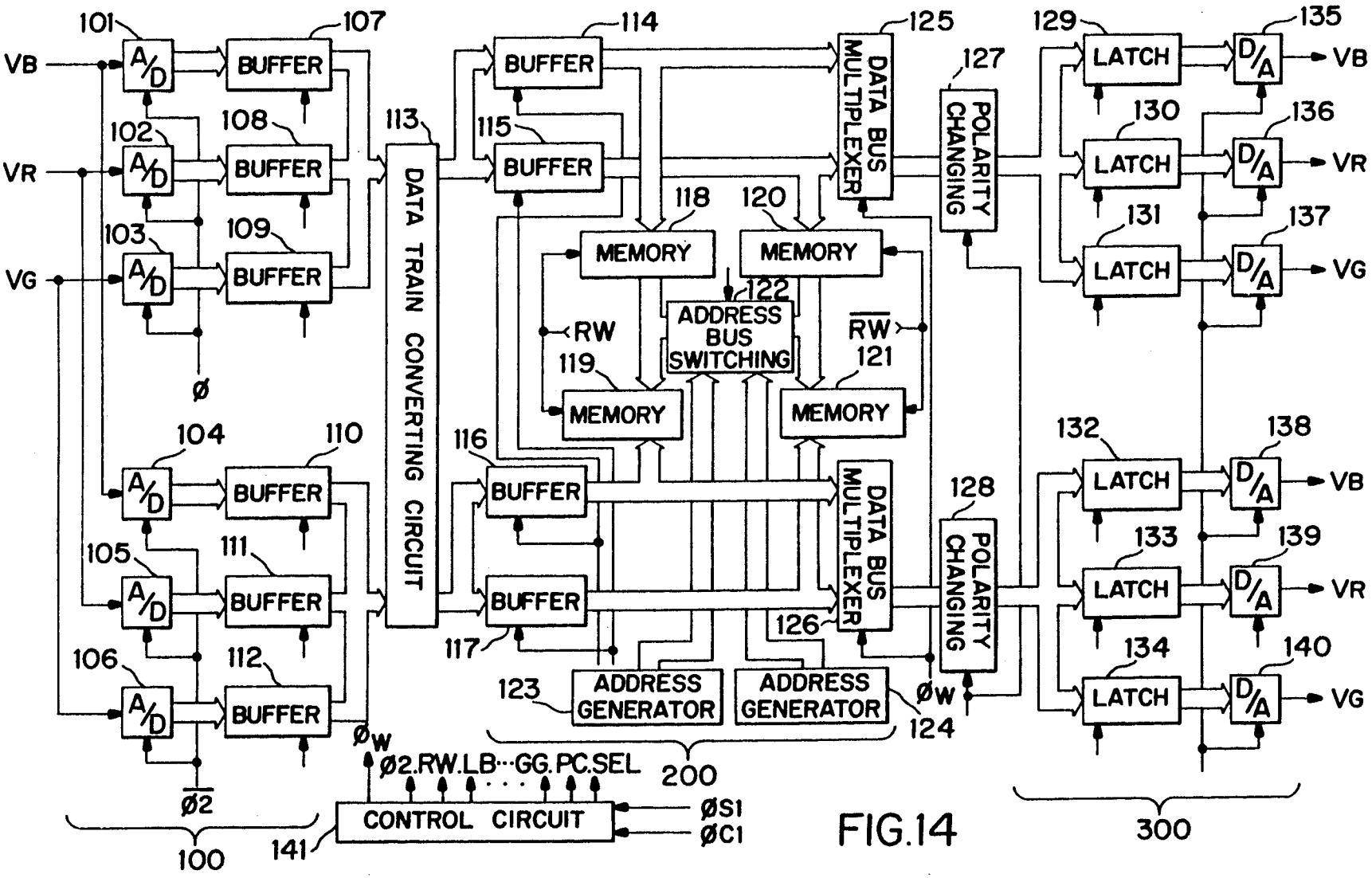
FIG. 14 shows a specified structure of a line memory circuit which provides video signals for the high speed line sequential system according to another embodiment of the invention.

A specified construction of the line memory circuit 142 (as shown in FIG. 11) for supplying the video signals to the respective source drivers 143 to 146 is shown in FIG. 14. Referring to FIG. 14, the line memory circuit 142 comprises: a block 100 for providing video signals for two rows for an odd-numbered gate line and an even-numbered gate line (namely, two gate lines) from the video signals $V_B$, $V_R$, $V_G$ for one horizontal period; a data train converting circuit 113 for providing a data train in which the video signals for the two gate lines from the block 100 are arranged selectively as a video signal for the even-numbered source lines and a video signal for the odd-numbered source lines; a memory block 200 for dividing the video signal data for the odd-numbered source lines and the video signal data for the even-numbered source lines from the data train converting circuit 113 into video signal data for the source lines of the first half and video signal data for the source lines of the second half, classifying the data into eight groups in total (groups of the odd-numbered gate line, the even-numbered gate line, the odd-numbered source lines, the even-numbered source lines, the source lines of the first half, and the source lines of the second half) and storing the data in those eight groups, and reading alternately the video signal data for the source lines of the first half and for the source lines of the second half with respect to one gate line; polarity changing circuits 127, 128 for changing the polarities of the signals of the video signal data from the memory block 200 according to the odd-numbered gate line and the even-numbered gate line; and a block 300 for receiving the video signal data from the polarity changing circuits 127, 128 and providing three separate trains of video signal data for the respective colors R, G, B from one train of video signal data.

The block 100 which provides video signal data for two gate lines comprises A/D converters 101 to 106 for sampling the respective analog video signals $V_G$, $V_R$, $V_B$ at prescribed timings and converting the same to digital signals; and 3-state buffers 107 to 112 for accepting the respective outputs of the A/D converters 101 to 106 with prescribed timing to output the same. The A/D converter 101 to 103 provide video signal data corresponding to one gate line (e.g., an odd-numbered gate line) and the A/D converters 104 to 106 provide video signal data corresponding to other gate line (e.g., an even-numbered gate lines). The group of the buffers 107 to 109 and the group of the buffers 110 to 112 have different timings for accepting and outputting the signals and, in those buffers, three trains of video signal data (corresponding to the R, G, B signal data) are converted to one train of data.

The memory block 200 comprises four line memories 118, 119, 120 and 121 in total, namely, a pair of two memories, the one for storing video signal data to be supplied to odd-numbered source lines and the other for storing video signal data to be supplied to even-numbered source lines, and another pair of similar memories for performing writing operation and reading operation in the memories simultaneously. The memories 118, 119 operate as a pair, and the memories 120, 121 operate as a pair. Thus, while data is written in the memories 118, 119, data is read from the memories 120, 121. Video data to be supplied to odd-numbered source lines, for example, are written in the memories 118, 120. Further, video signal data to be supplied to even-numbered source lines, for example, are stored in the memories 119, 121.

There are provided, between the data train converting circuit 113 and the memories 118, 120, 3-state buffers 114, 115 for receiving the output data train of the data train converting circuit 113, and a data bus multiplexer 125 for selectively transmitting either of the outputs of the buffers 114, 115 to one of the memories 118, 120 and connecting the output bus of the memory where data is not written to the polarity changing circuit 127. There are provided, between the memories 119, 121 and the data train converting circuit 113, 3-state buffers 116, 117 for transmitting the output of the data train converting circuit 113, and a data bus multiplexer 126 for connecting data writing lines from the buffers 116, 117 to the memories 119, 121, and data reading lines from the memories 119, 121 to the polarity changing circuit 128.

The output of the 3-state buffer 114 is transmitted to the memory 118 and the output of the 3-state buffer 115 is transmitted to the memory 120. The output of the 3-state buffer 116 is transmitted to the memory 119 and the output of the 3-state buffer 117 is transmitted to the memory 121. The data bus multiplexer 125 transmits the output of the memory 120 to the polarity changing circuit 127 while data from the buffer 114 is being written in the memory 118. Similarly, the data bus multiplexer 126 transmits the output of the memory 121 to the polarity changing circuit 128 while the output of the buffer 116 for example is being written in the memory 119. The above described construction makes it possible to prevent occurrence of confliction between the write data and the read data on the data bus.

For each of the memories 118 to 121, there are provided a write address generating circuit 123 for providing a write address, a read address generating circuit 124 for providing read addresses of the memories 118 to 121, and an address bus switching circuit 122 for transmitting selectively the address signals from the write address generating circuit 123 and the read address generating circuit 124 to the memories 118, 119 and to the memories 120, 121 according to the reading operation and the writing operation of the respective memories.

The address bus switching circuit 122 transmits the output of the address generating circuit 123 to the memories 118, 119 while the memories 118, 199 carry out writing operation. Further, at the same time, it transmits the address from the read address generating circuit 124 to the memories 120, 121. Thus, the address bus switching circuit 122 transmits the read address from the read address generating circuit 124 to the memory which carries out reading operation, and transmits the write address from the write address generating circuit 123 to the memory which carries out writing operation.

The block 300 comprises latch circuits 129 to 134 formed by D-flip-flops for example, for converting one train of data provided through the polarity changing circuits 127, 128 to three trains of video signals (i.e., the respective video signals of R, G, B), and D/A converters 135 to 140 for converting the respective outputs of the latch circuits 129 to 134 to analog signals with prescribed timing. The group of the latch circuits 129 to 131 and that of the latch circuits 132 to 134 have different latch timings and each group carries out latching operation at prescribed timing for one train of data provided from each of the polarity changing circuits 127, 128, whereby only the video signal data of the corresponding colors are latched. More specifically, the latch circuits 129, 132 latch the B video signal data, the latch circuit 130, 133 latch the R video signal data, and the latch circuits 131, 134 latch the G video signal data.

In order to control the operation timing of each block, a control circuit 141 is provided which starts operation in response to a line memory start signal $\phi s1$, has its operation timing defined in response to a line memory clock signal $\phi c1$, and provides various control signals with prescribed timing. Next, operation of each circuit block will be described. In the following, in order to simplify the explanation, only the operation of one circuit, namely, the operation of an even-numbered or odd-numbered gate line and a pair of memories will be described.

Figure 15:
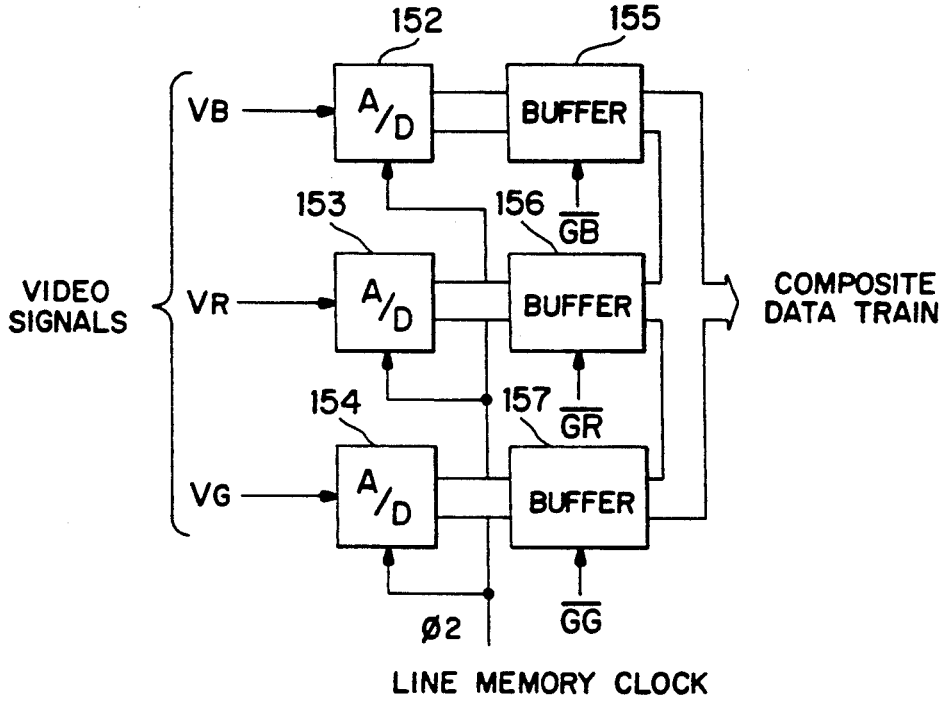
FIG. 15 is a block diagram showing a construction for providing two sets of video signal data for odd-numbered gate lines and for even-numbered gate lines from video signals for one horizontal period in the line memory circuit shown, in FIG. 14.

First, referring to FIGS. 15 and 16, description is made of the operation for providing digital video data for the even-numbered and odd-numbered gate lines from the video signal for one horizontal period. FIG. 15 shows a construction for providing video signal data corresponding to one gate line.

FIG. 15 shows A/D converters 152–154 which effect A/D conversion in response to a line memory clock $\phi 2$, and 3-state buffers 155 to 157 which accept and provide the data at different timings. The 3-state buffer 155 accepts and outputs the data in response to a control signal (gate) $\overline{GB}$, the buffer 156 accepts and outputs the data in response to a control signal $\overline{GR}$ and the buffer 157 accepts and outputs the data in response to a control signal $\overline{GG}$.

The respective analog video signals $V_B$, $V_R$, $V_G$ are sampled in the A/D converters 152 to 154 at the rise of the line memory clock $\phi 2$ and those signals are outputted as digital video data in response to the next fall of the clock $\phi 2$. The respective 3-state buffers 155 to 157 output the signals supplied thereto when the respective control signals $\overline{GB}$, $\overline{GR}$, $\overline{GG}$ attain L level. The control signals $\overline{GB}$, $\overline{GR}$, $\overline{GG}$ form three-phase non-overlapping clocks synchronizing with the clock signal $\phi 2$ as shown (f), (g) of FIG. 16 and accordingly, the data trains outputted from the buffers 155 to 157 have the same order as the color arrangement of the color filters of the liquid crystal panel.

Although the A/D converters 152 to 154 provided corresponding to the respective colors R, G, B are driven in response to the same clock, the clock phase for the odd-numbered gate lines and that for the even-numbered gate lines are different by 180° for the below described reasons. In the above described construction, the video signal data for one pixel in the horizontal direction of the liquid crystal panel is sampled and outputted for one clock of the A/D converters. On the other hand, in the case of the color filters having the delta arrangement, the arrangement of pixels of the odd-numbered gate lines and that of the even-numbered gate lines are staggered by 1.5 pixel. This staggering of 1.5 pixel causes a lag of 1.5 clock cycle in the clock signal $\phi 2$. The difference of 1.5 clock cycle is equal to a value obtained by adding a clock phase 180° to the lag of 1 clock cycle and the lag of 1 clock cycle is equal to the clock phase of 360°, namely, 0°. In consequence, it is only necessary to delay the clock phase of the corresponding A/D converter by 180° between the odd-numbered and even-numbered gate lines. Accordingly, the activation timing of the buffers 155 to 157, namely, the buffers 107 to 109 in FIG. 14 and that of the buffers 110 to 112 differ from each other by a half of the line memory clock $\phi 2$. Since the video signal data of one color is outputted from the buffers 155 to 157 in response to one line memory clock $\phi 2$, one train of composite data is provided to the data train converting circuit 113 as shown in FIG. 16(*k*). Thus, by providing one digital data train, it becomes possible to carry out digital processing at high speed simultaneously for all the three colors and the number of circuit components can be reduced.

The digital video data trains for the odd-numbered and even-numbered gate lines formed by the buffers 107 to 109 and 110 to 112 are supplied to the data train converting circuit 113 and they are converted to a digital signal data train to be applied to the odd-numbered source lines and a digital signal data train to be applied to the even-numbered source lines. Next, the specified construction and the operation of the data train converting circuit 113 will be described with reference to FIGS. 17 and 18.

Figure 17:
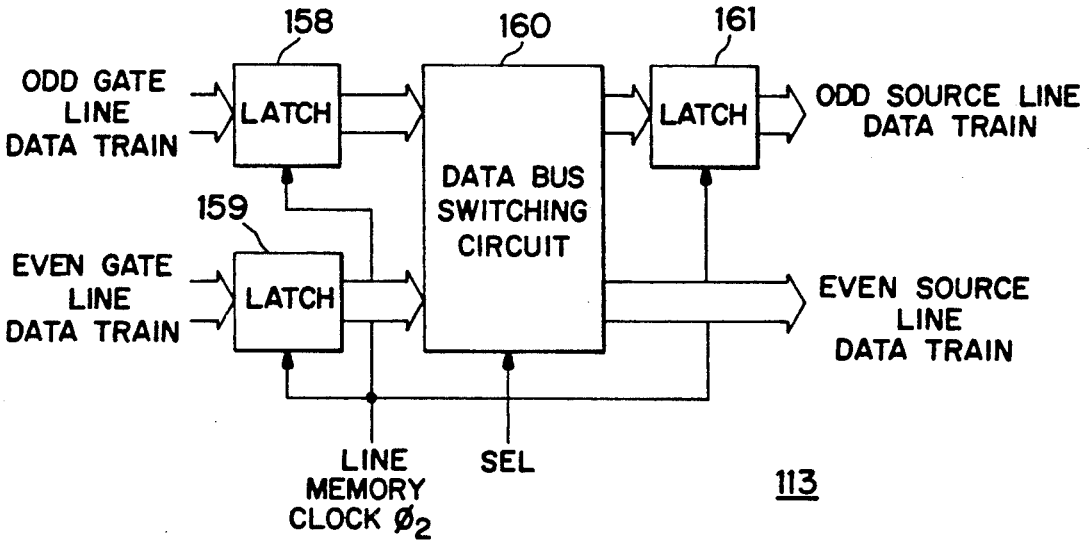
FIG. 17 is a block diagram showing an example of specified construction of a data train converting circuit of the line memory circuit shown in FIG. 14.

Referring to FIG. 17, the digital data train converting circuit 113 comprises: a latch circuit 158 formed by a D-flip-flop for example which receives the video signal data train for the odd-numbered gate lines; a latch circuit 159 formed by a D-flip-flop for example which receives the video signal data for the even-numbered gate lines; a digital bus switching circuit 160 which receives the signals from the latch circuits 158, 159 and selects a transmission line in response to a selection signal SEL; and a latch circuit 161 formed by a D-flip-flop for example which latches the signal from the digital bus switching circuit 160.

A data train to be applied to the odd-numbered source lines is outputted from the latch circuit 161 and a digital data train to be applied to the even-numbered source lines is outputted from the digital bus switching circuit 160 directly through other data bus. The latch circuits 158, 159 and 161 carry out latch operation in response to the line memory clock $\phi 2$. The selection signal SEL applied to the digital bus switching circuit 160 has a cycle twice larger than that of the line memory clock $\phi 2$. Next, the operation will be described.

As shown in FIG. 18, the output timing of the digital signal data train for the odd-numbered gate line and that for the even-numbered gate line are different from each other by 1.5 clock (see FIGS. 18(*b*) and (*c*)). The digital signal data train for the odd-numbered gate line and that for the even-numbered gate line having the phases different from each other by 1.5 clock are supplied to the latch circuits 158, 159, respectively and latched by the same line memory clock $\phi 2$. Since the latch circuits 158, 159 are formed by the D-flip-flops, the data trains are outputted from the latch circuits 158, 159 with a delay of 1 clock (as shown in FIGS. 18(*d*), (*e*)). The data trains having the phases with the delay of 1 clock are switched in the digital bus switching circuit 160 in response to the selection signal SEL. More specifically, by switching of the input/output connection lines in the digital bus switching circuit 160, the digital data train to be applied to the odd-numbered source lines and the digital data train to be applied to the even-numbered source lines are outputted from the digital bus switching circuit 160 as shown in (g), (h) of FIG. 18.

On this occasion, the digital data for the even-numbered gate lines and that for the odd-numbered gate lines appear alternately in the respective data trains. Since the output signal from the digital bus switching circuit 160 has the phase delayed by 1 clock as shown in FIG. 18, it is necessary to carry out operation of writing of the digital data directly in the memories with a delay of 1 clock and it is also necessary to generate a write address for the memories with a delay of 1 clock. Accordingly, if the above mentioned construction is adopted, there is disadvantage that the circuit size is increased.

Consequently, in order to write the data into the memories without correction of such clock delays, the digital data train having the phase advanced by 1 clock out of the output signal data trains from the digital bus switching circuit 160 (i.e., the digital signal data train to be applied to the odd-numbered source lines in FIGS. 17 and 18) is latched again in the latch circuit 161 formed by the D-flip-flop and the transmission thereof is delayed by 1 clock, whereby the timing of the video signal data train to be applied to the even-numbered source lines and the timing of the video signal train to be applied to the odd-numbered source lines can be made coincident. As a result, writing operation for the digital data in the memories (for the digital data for the odd-numbered and even-numbered source lines) can be carried out simultaneously and the write addresses for the memories can be generated by one write address generating circuit so as to be assigned to the respective memories. This makes it possible to reduce the number of components. Next, data writing and reading operations in the memory block 200 will be described.

Since the video signals need to be processed sequentially, two memories for the odd-numbered source lines and two memories for the even-numbered source lines are provided, so that switching occurs between reading and writing operations in each memory for one horizontal period. The capacity of each of the memories (118 to 121) can be evaluated by taking account of the write and read addresses, the source line first half/second half switching bit X, and the odd-numbered gate line/even-numbered gate line switching bit Y. Assuming that the number of pixels for one horizontal period is 640 as mentioned above and that four source drivers are provided, the source line first half/second half switching bit X is obtained as follows:

$$X \geqq \log_2(N/4) = \log_2(160)$$

Thus, X=8. On the other hand, the odd-numbered gate line/even-numbered gate line switching bit Y is as indicated below, because after processing of the data of all the source lines (640), the subsequent gate line is scanned and a capacity for storing the data of all the source lines is required as an address area for each gate line.

$$Y = X + 1 = 8 + 1 = 9$$

Consequently, the storage capacity for one memory is 1024 words, which is calculated from $2^{(Y+1)}$. The length of each of those words is defined by the resolutions of the A/D converters and D/A converters.

Switching between the writing and reading operations for the memories 118 to 121 occurs for one horizontal period. Writing and reading of data are selectively controlled by the 3-state buffers 114 to 117 provided in the preceding stages of the respective memories, and by the data bus multiplexers 125 and 126 provided in the reading lines of the memories 118 to 121 in order to selectively switch between the writing and reading of data for the memories 118 to 121 and to avoid collision between the read data and the write data.

More specifically, in the data writing operation for the memories 118 and 119, the 3-state buffers 114 and 116 provided in the preceding stages of the memories 118 and 119 are enabled and the video signal data train from the data train converting circuit 113 is written in the memories 118 and 119. Conversely, in the data reading operation from the memories 118 and 119, the 3-state buffers 114 and 116 provided in the respective preceding stages are disabled so that the data read from the memories 118 and 119 may not collide with the data from the data train converting circuit 113.

The data bus multiplexers 125, 126 provided in the succeeding stages of the memories (i.e, in the succeeding stages in the reading lines) always select the data bus connected to the memory where reading is effected, out of the memories 118 to 121 and connect the selected data bus to the polarity changing circuits 127, 128 in the succeeding stages. Accordingly, the switching control signal $\phi_W$ applied to the data bus multiplexers 125, 126 become a control signal synchronizing with the write/read control signal RW applied to the memories 118 to 121 and the connection lines for the data bus is selectively changed for each horizontal period.

Figure 19A:
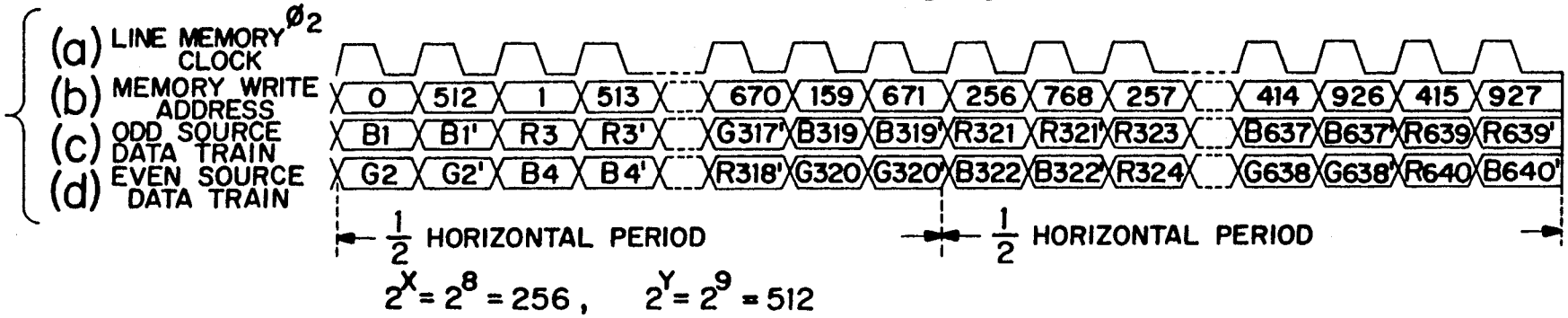
FIGS. 19A(*a*)–(*d*) are timing charts showing operation of writing trains of data obtained by the data train converting circuit into memories.

The write address for designating a write position in the memory, provided from the write address generating circuit 123 is incremented by one according to the output timing of the data from the data train converting circuit 113, as shown in FIG. 19A, while resetting and setting of the odd-numbered gate line/even-numbered gate line switching bit Y are repeated. Similarly, the source line first half/second half switching bit X is reset in the first ½ horizontal period and it is set in the second ½ horizontal period. At the time when the switching bit X is switched, the less significant address (the address excluding the switching bits X and Y) is reset.

Figure 19B:
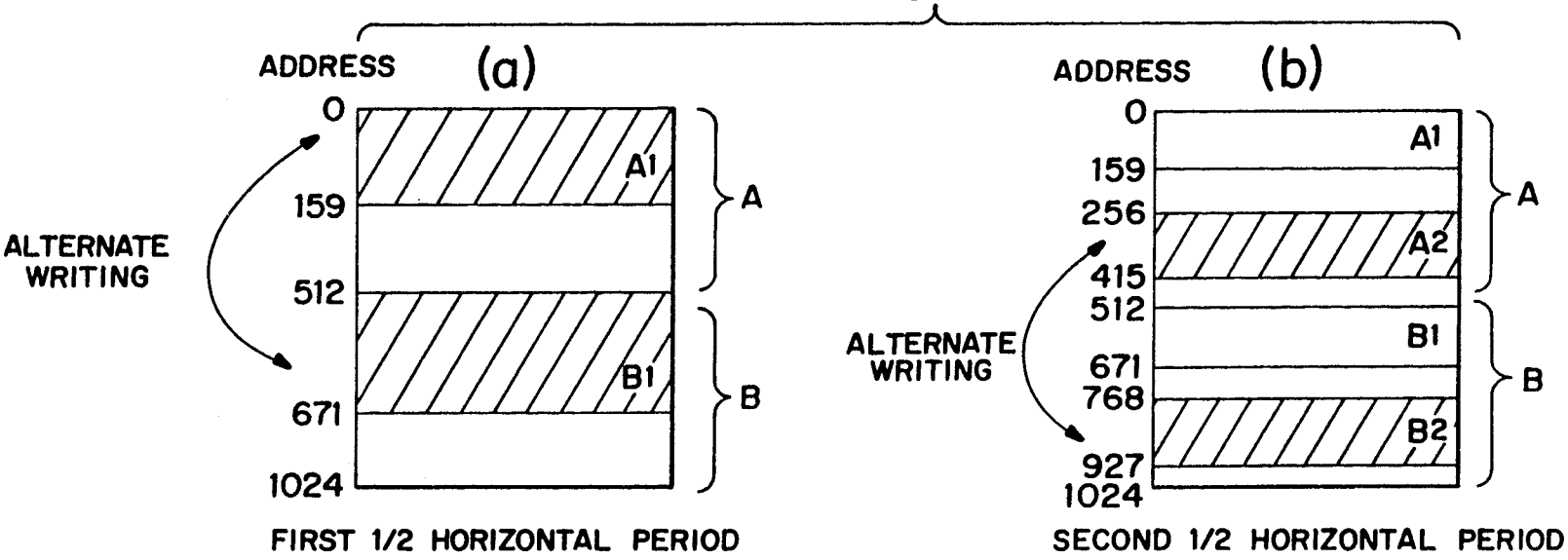
FIGS. 19B(*a*)–(*b*) is a schematic diagram showing operation of writing of data into each memory and showing write areas in each memory.

More specifically, the write addresses in the first ½ horizontal period are 0, $2^Y+0$, 1, $2^Y+1$, . . . , N/4−1, $2^Y+N/4-1$ and those in the second ½ horizontal period are $2^X+0$, $2^X+2^Y+0$, $2^X+1$, $2^X+2^Y+1$ . . . , $2^X+N/4-1$, $2^X+2^Y+N/4-1$. As described previously, in the case of the number N of pixels for one horizontal period being 640, the write addresses generated in the first ½ horizontal period are 0, 512, 1, 513, . . . , 159, 671 and the write addresses generated in the second ½ horizontal period are 256, 768, 257, 769, . . . , 415, 927, as shown in FIG. 19A. Further, as shown in FIG. 19A, in both of the video train for the odd-numbered source lines and the video data train for the even-numbered source lines, the odd-numbered gate line video signal data and the even-numbered gate line video signal appear alternately and the write addresses for the respective data are switched by the switching bits X and Y. In consequence, as shown in FIG. 19B, the video signal data are written alternately in the areas A1 and B1 of the memory in the first ½ horizontal period, and the video signal data are written alternately in the areas A2 and B2 of the memory in the second ½ horizontal period. In FIG. 19B, the area A is an area where the video digital signal data for the even-numbered gate lines are stored and the area B is an area where the video digital signal data for the odd-numbered gate lines are stored. Accordingly, each of the memories for the odd-numbered and even-numbered source lines has four divided areas and thus the video signal data are stored in a manner divided in the eight areas in total.

The addresses for reading the digital data from the memories 118 to 121 are generated from the read address generating circuit 124 and transmitted through the address bus switching circuit 122 to the memory where reading operation is being carried out. The read address generated from the read address generating circuit 124 is incremented by one while the source line first half-/second half switching bit X is reset and set alternately and repeatedly as shown in FIG. 20A. If the odd-numbered gate lines are selected in the first ½ horizontal period, the odd-numbered/even-numbered gate line switching bit Y is reset. If the even-numbered gate line are selected in the second ½ horizontal period, the odd-numbered/even-numbered gate line switching bit Y is set. Thus, in reading of data, if the odd-numbered gate lines are selected, the switching bit Y is reset and if the even-numbered gate lines are selected, the switching bit Y is set.

If the color order of the arrangement of the color filters of the liquid crystal panel is B, G, R . . . , the data are stored in the memories in this order. Accordingly, the color order of the video signal data read by the above described read addresses is B(0), R(256), R(1), G(257), G(2), B(258), etc. on the odd-numbered source lines and the color order of the data read on the even-numbered source lines is G(0), B(256), B(1), R(257), R(2), G(258), etc. where the numerals in the parentheses represent the addresses. Accordingly, if the video digital signal data train thus read is converted to analog video signals by D/A conversion, signals of the same color are contiguous to each other, no allowance exists for selecting the signals and transmitting the signals selectively to the source drivers for driving the liquid crystal panel.

Therefore, in reading of data, the source line first half/second half switching bit X is set and reset repeatedly oppositely to the case of writing of data, whereby it is incremented by one. More specifically, if the source drivers accept the data starting from the data of the second half of the source lines, the color order of the video digital data on the odd-numbered source lines is R, B, G, R, B, G while that on the even-numbered source lines is B, G, R, B, G, R. This arrangement is the same as the color arrangement of the color filters of the liquid crystal panel, which makes it possible to easily distribute the signals to the source drivers.

More specifically, if the video signal data for the odd-numbered gate lines are applied in the first ½ horizontal period, the read addresses are $2^X+0$, 0, $2^X+1$, 1, . . . , $2^X+N/4-1$, $N/4-1$ and if the digital video data for the even-numbered gate lines are applied in the second ½ horizontal period, the read addresses are $2^Y+2^X+0$, $2^X+0$, $2^Y+0$, $2^Y+2^X+1$, $2^Y+1$, . . . , $2^Y+2^X+N/4-1$, $2^Y+N/4-1$.

Practically, if the above described values are specifically shown, the read addresses in the first ½ horizontal period are 256, 0, 257, 1, . . . , 415, 159 and the read addresses in the second ½ horizontal period are 768, 512, 769, 513, . . . , 927, 671 as shown in FIG. 20A. Thus, as shown in FIG. 20B, if the even-numbered gate lines are selected, the data are read from the memory for the odd-numbered source lines in the order of the areas A2, A1 alternately. If the odd-numbered gate lines are selected, the data are read alternately in the order of the areas B2, B1. The same applies to the memory for the even-numbered source lines and the data are read alternately in the order of the area A2', A1' or in the order of the areas B2', B1' in the manner as shown in FIG. 20B (b).

Thus, the read addresses and the write addresses for the memories can be made to be common to both of the memory for the odd-numbered source lines and the memory for the even-numbered source lines. Consequently, only by providing one address generating circuit for each of writing and reading, and assigning the addresses from the address generating circuit simply by means of the address bus switching circuit 122, it is possible to write and read video signal data. As for the digital video signal data read through the data bus multiplexers 125, 126, the respective bit values thereof are inverted in the digital polarity changing circuits 127, 128. An example of specified construction of each of the digital polarity changing circuits 127, 128 is shown in FIG. 21.

Referring to FIG. 21, the digital polarity changing circuit comprises eight Ex-OR gates 162-1 to 162-8. The construction shown in FIG. 21 is the construction in which the video digital signal data has eight bits, that is, the digital data for one pixel has an 8-bit width. A polarity change signal PC is applied from a control circuit 141 to one input of each of the Ex-OR gates 162-1 to 162-8. Normally, the Ex-OR gates output a signal of high (H) level if the bit values of both inputs thereof are not coincident, and output a signal of low (L) level if the bit values of both inputs are coincident. Accordingly, if the polarity change signal PC is of L level, each of the Ex-OR gates 162-1 to 162-8 permits the input video digital signal data to pass therethrough and if the polarity change signal PC is of H level, each of the gates inverts the bit value of the video digital data supplied thereto and outputs the inverted value. The levels of the polarity change signal PC are changed dependent on the first ½ horizontal period and the second ½ horizontal period as shown in FIG. 22. In other words, a cycle of the polarity change signal PC is one horizontal period. Accordingly, the polarities of the signals are different by 180° dependent on the first ½ horizontal period and the second ½ horizontal period. Thus, the signal polarities can be inverted for the odd-numbered gate lines and the even-numbered gate lines and signal switching in the high speed line sequential system can be attained. The signal having passed through the polarity changing circuits 127, 128 is one train of digital video data. In order to supply the train of digital video data to the respective D/A converters 135 to 140 provided corresponding to the colors R, G, B, the digital signal data train is transmitted to the latch circuits 129 to 134 formed by the D-flip-flops, where it is latched with different timings and converted to parallel three trains of digital video signal data corresponding to the respective colors R, G, B. Since operation in the path for providing the video signal to be transmitted to the odd-numbered source lines and that in the path for providing the video signal to be transmitted to the even-numbered source lines are the same, only the operation of one path will be described in the following with reference to FIGS. 23 and 24.

FIG. 23 shows a latch circuit 163 formed by a D-flip-flop for latching the B signal, a latch circuit 164 formed by a D-flip-flop for latching the R signal, and a latch circuit 165 formed by a D-flip-flop for latching the G signal. The latch circuits 163 to 165 include A/D converters 166 to 168, respectively, for converting the outputs therefrom to analog signals. The latch circuit 163 carries out latch operation in response to a latch control signal LB, the latch circuit 164 carries out latch operation in response to a latch control signal LR, and the latch circuit 165 carries out latch operation in response to a latch control signal LG. Those control signals LB, LR, LG form clock signals of three phases different and not overlapping with each other and the cycle of each of the control signals LB, LR, LG has a cycle twice larger than that of the line memory clock $\phi 2$. First, let us assume that the composite data train outputted from the data polarity changing circuit is in the order of R, B, G, R . . . as shown in FIG. 24(*b*).

In this case, the latch circuit 164 carries out latch operation in response to the control signal LR and subsequently the latch circuits 165 and 163 carry out latch operation in this order. Since each of the latch circuits 163 to 165 carries out latch operation for three line memory clocks $\phi 2$, the data maintaining period of each of the latch circuits 163 to 165 is a period of three line memory clocks $\phi 2$. The output signals of the respective D/A converters 135 to 140 (166 to 168) are transmitted to the corresponding source drivers 143 to 146. Among the source drivers 143 to 146 shown in FIG. 11, the source drivers 143 and 145 connected to the source lines of the first half operate in response to the same clock and the source drivers 144 and 146 connected to the source lines of the second half operate in the same clock. Accordingly, as for the odd-numbered source lines, the source drivers for the second half and the source drivers for the first half accept data alternately, and similarly the source drivers 145 and 146 connected to the even-numbered source lines accept data alternately.

The data outputted from the respective D/A converters 135 to 140 in response to clock signals $\phi 4$, $\overline{\phi 4}$ for driving the source drivers 143 to 146 are sampled and held in the analog sample-and-hold circuits 151 in the corresponding source drivers. On this occasion, as shown in FIGS. 24 (j), (k), each of the cycles of the clocks $\phi 4$, $\overline{\phi 4}$ for the source drivers has a cycle twice larger than that of the line memory clock $\phi 2$ and each of the source drivers can operate with the same operation speed as that in the double speed line sequential system or the interlace system. More specifically, referring to FIGS. 13 and 24, in the source drivers connected to the odd-numbered source lines, first, the source driver for driving the source lines of the second half operates and samples the R signal (R321) and then the source driver for driving the source lines of the first half operates and samples the B signal (B1). Subsequently, the signals G323, R3, B325, G5 are sampled successively. This sampling operation is carried out by successively turning on the analog switches 150 (150-1 to 150-m) included in the respective source drivers. Accordingly, even if the outputs of the D/A converters 166 to 168 (135 to 140) are provided simultaneously, the three signal lines are arranged in parallel and connected to the analog switches sequentially Thus, consequently, only the video signal corresponding to one of the three outputs is sampled in the analog sample-and-hold circuit 151. The analog sample-and-hold circuit 151 transmits the data to the corresponding source line after completion of all of the sample-and-holding operations for the signals supplied thereto in connection with one gate line. Thus, it becomes possible to drive the liquid crystal panel in the high speed line sequential system by operating the respective source drivers with the same speed as that in the conventional double speed line sequential system and interlace system. The manner of division of the areas of the display panel and the number of source drivers are not limited to those in the above described embodiments.

Thus, according to the present invention, the liquid crystal panel can be driven only by one line memory circuit for the three colors and accordingly it is possible to provide an inexpensive liquid crystal drive device having a simplified structure with low consumption of power.

In addition, at least a pair of memories are used so that video data is written in one of the memories and is read from the other memory, and the read video data is transmitted alternately to the source drivers for driving the first half of the liquid crystal panel and to the source drivers for driving the second half thereof. Accordingly, it is possible to obtain a liquid crystal drive device having excellent linearity, which drives the liquid crystal panel at high speed in an equivalent manner even if it operates with low speed clocks.

In addition, according to the present invention, the memory region is divided into areas for the even-numbered gate lines, the odd-numbered gate lines, the odd-numbered source lines, the even-numbered source lines, the source lines of the first half and the source lines of the second half, and color video data converted to a data train is stored in each of the areas and is read successively according to a prescribed order. Thus, the liquid crystal panel in the high speed line sequential system can be driven while the source drivers for driving the liquid crystal panel is operated with the same speed as that in the conventional double speed line sequential system or the conventional interlace system. In consequence, it becomes possible to improve the horizontal resolution and the responsitivity for moving pictures and to suppress occurrence of flickering and the liquid crystal panel having a high quality of image for a large screen can be driven with a reduced number of components.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A device for driving a color liquid crystal display panel, the display panel including at least a plurality of color pixels arranged in a matrix of rows and columns according to a predetermined color order and a plurality of source lines, each of which is connected to one column of the plurality of color pixels having the same color, the plurality of source lines being divided into at least first and second groups, and each of the first and second groups being further divided into first and second sub-groups, said device comprising:

signal transmitting means for transmitting a signal to each of said plurality of source lines, said signal transmitting means includes first source drive means and second source drive means provided corresponding to said first and second groups of said source lines, respectively, and each of said first and second source drive means including a first driver provided corresponding to said first sub-group and a second driver corresponding to said second sub-group, said first driver and second driver being activated alternately for latching a color signal supplied thereto;

first signal supply means and second signal supply means provided corresponding to said first and second source drive means, respectively, for supplying color signals to the corresponding source drive means, each of said first and second signal supply means including input converting means for receiving a plurality of types of analog color signals of a plurality of different colors supplied in parallel and for converting the plurality of types of analog color signals to a serial digital data train, including the plurality of types of color signals arranged in a color order corresponding to the color order defined by the source lines of the corresponding group, and a plurality of storing means for storing an output of said first converting means according to an address, each said storing means including a first area for storing data to be transmitted to said first sub-group and a second area for storing data to be transmitted to said second sub-group;

writing means for successively writing data into the first and second areas of each of said storing means at sequential addresses;

reading means for successively reading the stored data from a first of said storing means, said reading means including alternate reading means for reading the data alternately from said first area and said second area, said reading means and said one of said plurality of storing means and reading data from another of said plurality of storing means to produce a high speed signal supply means; and output converting means for converting a serial data train read from said reading means to analog signals and transmitting the analog signals to the corresponding source drive means, said analog converting means including second converting means for converting said thus read serial data train to parallel analog signals for each respective color and outputting the parallel analog signals.

2. The device according to claim 1, wherein said plurality of source lines includes odd-numbered source lines constituting said first group, and even-numbered source lines constituting said second group, and include source lines of a first half constituting each said first sub group, and source lines of a second half constituting each said second sub group, said alternate reading means including means for reading data alternately in an order of said second area and said first area of said storing means.

3. The device according to claim 1, wherein said storing means comprises at least first and second memories each having a capacity sufficient for storing data to be transmitted to one row of pixels, said device further comprising means for controlling operation of said storing means to read data from one of the first and second memories while data is being written in the other of the first and second memories.

4. The device according to claim 1, wherein said first converting means includes a plurality of A/D converting means provided corresponding to said plurality of types of analog color signals supplied in parallel respectively, for converting the corresponding analog color signals to digital signals, a plurality of buffer means provided corresponding to said plurality of A/D converting means, respectively, for accepting the outputs of the corresponding A/D converting means at prescribed timing and outputting the outputs, said plurality of buffer means being activated sequentially and periodically according to an order following the color order of the source lines of the corresponding groups, and means for receiving the outputs of said plurality of buffer means, converting the outputs to a digital data train and supplying said data train to said storing means.

5. The device according to claim 1, wherein said second converting means includes a plurality of latch means provided in parallel, for latching the digital data read by said reading means at different timings, said plurality of latch means being a means for outputting the plurality of types of color signals in parallel, and being activated successively and periodically according to an order of acceptance of the color signals by the corresponding source drive means, to latch and output the supplied data, D/A converting means provided corresponding to said latch means, respectively, for converting the outputs of the corresponding latch means to analog signals, and means provided corresponding to said D/A converting means, respectively, for transmitting the outputs of the corresponding D/A converting means to an associated source drive means, in parallel.

6. A device for driving a color liquid crystal display panel, the liquid crystal panel including a plurality of color liquid crystal pixels arranged according to a predetermined color order, a plurality of source lines for transmitting signal potentials to the plurality of liquid crystal pixels, and a plurality of gate lines provided in a direction intersecting with the plurality of source lines for transmitting a signal activating one row of the plurality of liquid crystal pixels, one source line having liquid crystal pixels of the same color connected thereto, and the plurality of source lines being assigned numbers which successively increase so that the plurality of source lines are divided into a group of odd-numbered source lines, a group of even-numbered source lines, a group of source lines of a first half, and a group of source lines of a second half, said device comprising:

first and second drive means provided corresponding to said group of odd-numbered source lines and said group of even-numbered source lines, respectively, each of said first and second source drive means including a first source driver for transmitting a signal to the source lines of the first half, and a second source driver for transmitting a signal to the source lines of the second half, which are activated alternately, and each of said first and second source drive means including means for latching signals supplied thereto in an order following a color arrangement order of the corresponding source line groups and for transmitting the latched signals to the source lines of the corresponding groups with prescribed timing;

means for receiving an analog video signal corresponding to one row of said plurality of pixels and providing a serial digital signal data train to be displayed in the pixels connected to the first row and the second row forming a pair with said first row from said received video signal of the one row, said video signal including three kinds of color signals to be transmitted in parallel;

a plurality of storing means, each including a first and second area, for receiving an output of said signal data train providing means and for storing the received video signal data by dividing the stored video signal data into groups of signal data to be transmitted to said first row, said second row, said group of odd-numbered source lines, said group of even-numbered source lines, said group of source lines of the first half, and said group of source lines of the second half;

writing means for successively writing data into the first and second areas of each of the plurality of storing means;

reading means for reading, serially, the data to be transmitted to the pixels of said first row out of the data stored in the first and second areas of said storing means, in a prescribed order, and for then reading, serially, the data to be transmitted to the pixels of said second row in said predetermined order, said reading means and writing means operating so as to be concurrently writing data into first of the plurality of storing means to be transmitted to pixels of said second row and reading data from another of the plurality of storing means to be transmitted to pixels of said first row; and means for latching the serial data train provided from said reading means with prescribed timing, for converting the latched serial data train to said parallel analog color signals for each of the three colors and transmitting said color signals to said first and second source drive means, said transmitting means including first latch converting means for latching the data to be transmitted to said odd-numbered source lines out of the serial data train and converting the latched data, and second latch converting means for latching the data to be transmitted to said even-numbered source lines and converting the latched data.

7. The device according to claim 6, wherein said display panel comprises color filters of a delta arrangement in which the pixels of the respective adjacent gate lines are staggered by 1.5 pixel, and wherein said digital data train providing means includes first providing means for receiving the three different color signals in parallel and for providing the color signals to be transmitted to the pixels of the first gate line in a form of the serial digital signal train, said first providing means including means for providing digital data in a series having an arrangement of each of said three different color signals, in an order following the color order of the pixels connected to said first gate line, and second providing means activated with timing complementary to activation of said first providing means, for providing a serial digital data train having an arrangement of each of said three color signals, in the same order of the pixels connected to the second gate line.

8. The device according to claim 7, wherein said digital data train providing means further comprises first data train converting means for receiving the outputs of said first and second providing means and for providing a first data train composed of serial digital data to be transmitted to said odd-numbered source lines, and second data train converting means for providing a second data train composed of serial digital data to be transmitted to said even-numbered source lines, each of said first and second data trains including a serial data train in which the data to be transmitted to the pixels of said first gate line and the data to be transmitted to the pixels of said second gate line are arranged alternately.

9. The device according to claim 7, wherein said first providing means comprises first, second and third A/D converting means provided corresponding to said parallel analog color signals of each of the three colors, respectively, for converting the corresponding color signals to digital signals in response to clock signals, first, second, and third buffer means provided corresponding to said first, second, and third A/D converting means, respectively, for selectively passing the outputs of the associated A/D converting means therethrough, said first, second, and third buffer means being activated successively and periodically, thereby providing a serial digital data train arranged in an order following the color order of the pixels of said first row, fourth, fifth and sixth A/D converting means provided corresponding to said parallel analog color signals of each of the three colors, respectively, for converting the corresponding color signals to digital signals in response to inversion signals of said clock signals, and fourth, fifth and sixth buffer means provided corresponding to said fourth, fifth and sixth A/D converting means, respectively, for passing selectively the outputs of the corresponding A/D converting means therethrough, said fourth, fifth and sixth buffer means being activated successively and periodically, thereby providing a serial digital color signal train arranged in an order following the color order of the pixels of said second gate line, and the serial digital data train from said first, second and third buffer means being provided with timing different by 1.5 pixel period from that of the serial digital color data train from said fourth, fifth and sixth buffer means.

10. The device according to claim 7, wherein the serial digital data train from said first providing means has a phase advanced by 1.5 pixel from that of the serial digital data train from said second providing means, said digital data train providing means further comprises first latch means for latching and outputting the serial digital train from said first providing means in response to a clock signal, second latch means for latching and outputting the serial digital data train from said second providing means in response to said clock signal, train converting means for receiving the outputs of said first and second providing means, for exchanging the respective outputs of said first and second providing means in response to a selection signal and for providing a serial data train composed of data to be transmitted to said odd-numbered source lines and a serial data train to be transmitted to said even-numbered source lines, and third latch means for latching and outputting the serial digital data train for the odd-numbered source lines from said train converting means in response to said clock signal.

11. The device according to claim 8, wherein said storing means comprises first memory means for storing digital data for said odd-numbered source lines, said first memory means having a memory area of a first half and a memory area of a second half, second memory means for storing digital data for said even-numbered source lines, said second memory means having a memory area of a first half and a memory area of a second half, first writing means for writing the output of said first data train converting means alternately into said memory area of the first half and said memory area of the second half of said first memory means, and second writing means for writing the output of said second data train converting means alternately into said memory area of the first half and said memory area of the second half of said second memory means, said first and second writing means have, in common, means for generating an address designating a destination of data to be written in the corresponding memory means, and writes the data in the corresponding memory means according to the same address provided simultaneously from said write address generating means.

12. The device according to claim 11, wherein each of said memory areas of the first half and the second half of each of said first and second memory means is further divided into first and second sub-memory areas, said write address generating means generates the address so that the data is written alternately, in said first sub-memory area of said memory area of the first half and in said first sub-memory area of said memory area of the second half in a period of a first half of one horizontal scanning period in which one gate line is activated, and said write address generating means generates the address so that the data is written alternately, in said second sub-memory area of said memory area of the first half and in said second sub-memory area of said memory area of the second half in a period of a second half of said one horizontal scanning period.

13. The device according to claim 7, wherein said reading means comprises:

first reading means for alternately reading data to be transmitted to the source lines of the first half of said odd-numbered source line group of said first row and data to be transmitted to the source lines of the second half of said odd-numbered source line group of said first row from said storing means, and alternately reading, after the reading of said data for said first row, data to be transmitted to the source lines of the first half of said odd-numbered source line group of said second row and data to be transmitted to the source lines of the second half of said odd-numbered source line group of said second row, and second reading means for alternately reading data, to be transmitted to the source lines of the first half of said even-numbered source line group of said first row and data to be transmitted to the source lines of the second half of said even-numbered source line group of said first row from said storing means, and alternately reading after the reading of said data for said first row, data to be transmitted to the source lines of the first half of said even-numbered source line group of said second row and data to be transmitted to the source lines of the second half of said even-numbered source line group of said second row, the serial data trains read by said first and second reading means having the same color order as the color order of the pixels of the corresponding gate lines.

14. The device according to claim 12, wherein said reading means comprises first reading means for reading data from said first memory means, said first reading means alternately reading data of said first sub area of said memory area of the first half of said first memory means and data of said second sub area thereof in said first half period of said one horizontal period, and alternately reading data of said first sub area of said area of the second half of said first memory means and data of said second sub area thereof in said second half period of said one horizontal period, and second reading means for successively reading data from said second memory means, said second reading means alternately reading data of said first and second sub memory areas of said memory area of the first half of said second memory means in said first half period of said one horizontal period, and alternately reading data of said first and second sub memory areas of said memory area of the second half of said second memory means in said second half period of said one horizontal period, said first and second reading means having one read address generating means in common, and said first and second reading means reading the data with the same timing according to the same address from said read address generating means.

15. The device according to claim 6, further comprising means for receiving the data train from said reading means and for inverting the polarity of the data each time pixel data for one gate line are received therein.

16. The device according to claim 15, wherein said inverting means includes means for inverting each bit value of the received data.

17. The device according to claim 14, wherein said means for transmitting the signal to said source drive means comprises first, second and third latch means connected in parallel with each other, for latching and outputting the output of said first reading means with different timings, said first, second, and third latch means being activated successively and periodically to latch the supplied signal according to the color order of the source lines driving said first source drive means, first, second and third D/A converting means provided corresponding to said first, second and third latch means, respectively, for converting the outputs of the corresponding latch means to analog signals and transmitting the same to said first source drive means in parallel, fourth, fifth and sixth latch means providing in parallel with each other, for latching and outputting the output of said second data reading means with different timings, said fourth, fifth, and sixth latch means being activated successively and periodically to latch the supplied data according to the color order of said even-numbered source lines, and fourth, fifth and sixth D/A converting means provided corresponding to said fourth, fifth and sixth latch means, respectively, for converting outputs of the corresponding latch means to analog signals and transmitted the analog signals to said second source drive means in parallel.

18. The device according to claim 6, wherein said storing means comprises a first pair of memory elements for storing data for said odd-numbered source line group and data for said even-numbered source line group, and a second pair of memory elements in which data reading operation is effected when data writing operation is effected in said first pair of memory elements, and in which data writing operation is effected when data reading operation is effected in said first pair of memory elements.

19. A method for driving a color liquid crystal display panel, the display panel including a plurality of color liquid crystal pixels arranged according to a predetermined color order in a matrix of rows and columns, a plurality of source lines each of which is connected to the color liquid crystal pixels of one column, and a plurality of source lines each of which is connected to the color liquid crystal pixels of one row, first and second source drivers for driving a first half and a second half of odd-numbered source lines, respectively, and third and fourth source drivers for driving a first half and a second half of even-numbered source lines, respectively, being provided in the periphery of said display panel, said method comprising the steps of:

forming a first serial digital data train for said odd-numbered source lines and a second serial digital data train for said even-numbered source lines upon receipt of first analog color signals of three colors in parallel, said first serial digital data train including digital color signals of each of the three colors arranged in a color order of said odd-numbered source lines, and said second serial digital data train including digital color signals of each of the three colors arranged in a color order of said even-numbered source lines;

writing said first and second serial digital data trains in first and second memory elements, respectively, according to an address order, said first and second memory elements each having an address area of a first half and an address area of a second half;

alternately reading said area of the first half and said area of the second half from each of said first and second memory elements and providing a third serial digital data train and a fourth serial digital data train, said reading of the one memory element concurrently occurring with the writing of the another memory element;

converting said third and fourth serial digital data trains to second and third analog color signals of each of the three colors in parallel, transmitting said second analog color signal to said first and second source drivers and transmitting said third analog color signal to said third and fourth source drivers; and alternately activating said first and second source drivers and alternately activating said third and fourth source drivers, thereby holding said second analog signal in said first and second source driver and holding said third analog color signal in said third and fourth source drivers.

20. A method for driving a liquid crystal display panel to activate two adjacent gate lines in one horizontal scanning period, the liquid crystal display panel including a plurality of color liquid crystal pixels arranged according to a delta arrangement, a plurality of gate lines each of which is connected to the pixels of one row, and a plurality of source lines for transmitting signals to the plurality of pixels, the display panel including in its periphery a first source driver for providing the source lines of a first half out of odd-numbered source lines, a second source driver for driving the source lines of a second half out of said odd-numbered source lines, a third source driver for driving the source lines of a first half out of even-numbered source lines, and a fourth source driver for driving the source lines of a second half of said even-numbered source lines, the pixels of the same color being connected to one source line, said method comprising the steps of:

providing a first serial digital data train of color signals to be transmitted to the pixels on a first gate line, and a second serial digital data train of color signals to be transmitted to the pixels on a second gate line forming a pair with said first gate line, out of the first analog color signal of each of the three colors supplied in parallel, said first serial digital data train and said second serial digital data train having phases different from each other by 1.5 pixel, and said first and second serial digital data trains including digital color signals of each of the three colors arranged in the same order of the color order of the pixels on one gate line;

correcting the difference of the phases of said first and second serial digital data trains so that the difference corresponds to one pixel;

providing a third serial digital data train of color signals to be transmitted to said odd-numbered source lines, and a fourth serial digital data train of color signals to be transmitted to said even-numbered source lines out of said first and second serial digital data trains having the corrected phases, said third and fourth serial digital data trains having serial data trains in which the data for the first gate line and the data for the second gate line are arranged alternately, said third serial digital data train including a serial digital color signal train arranged in an order following the color order of said odd-numbered source lines, and said fourth serial digital data train including a serial digital color signal train arranged in an order following the color order of said even-numbered source lines;

adjusting the phase of said third serial digital data train and the phase of said fourth serial digital train to coincide with each other;

writing said third serial digital data train into the first memory element and said fourth serial digital data train into the second memory element, said first and second memory elements having first, second, third and fourth memory areas according to an address order, said writing step including the steps of writing the supplied digital data alternately into said first and third memory areas of said first and second memory elements in a first half period of said one horizontal scanning period, and writing the supplied data alternately into said second and fourth memory areas in the second half period of said one horizontal scanning period;

reading the data from said first memory element to provide a fifth serial digital data train and at the same time reading the data from said second memory element to provide a sixth serial digital data train, said reading step including the steps of reading the data alternately from said first and second memory areas of said first and second memory elements in the first half period of said one horizontal scanning period and reading the data alternately from said third and fourth memory areas thereof in the second half period of said one horizontal scanning period, said fifth serial digital data train including a serial digital color signal train of each of the three colors arranged in an order following the color order of said odd-numbered source lines, and said sixth serial digital data train including a serial digital color signal train of each of the three colors arranged in an order following the color order of said even-numbered source lines, said reading from one memory element occurring concurrent with the writing of another memory element;

forming the second analog color signal of each of the three colors in parallel from said fifth serial digital data train and supplying the formed second analog color signal to said first and second source drivers, forming the third analog color signal of each of the three colors in parallel from said sixth serial digital data train and transmitting the formed third analog color signal to said third and fourth source drivers, said second analog color signal forming step including the step of activating successively and periodically three latch means arranged in parallel to receive said fifth serial digital data train simultaneously, said third analog color signal forming step including the step of activating successively and periodically other three latch means arranged in parallel to receive said sixth serial digital data train simultaneously; and alternately activating said first and second source drivers to maintain said second analog color signal by said first and second source drivers, and alternately activating said third and fourth source drivers to maintain said third analog color signal by said third and fourth source drivers.

21. The method according to claim 20, further comprising the step of:

inverting polarities of said fifth and sixth serial digital data trains so that the polarities of the data are in an inverted relation in the first half period and the second half period of said one horizontal scanning period.

* * * * *